US007137750B2

(12) United States Patent
Fujioka et al.

(10) Patent No.: US 7,137,750 B2
(45) Date of Patent: Nov. 21, 2006

(54) RECORDING APPARATUS

(75) Inventors: Satoshi Fujioka, Nagano (JP); Takayuki Ishii, Nagano (JP); Yoshitaka Shimada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/820,877

(22) Filed: Apr. 9, 2004

(65) Prior Publication Data

US 2004/0232611 A1 Nov. 25, 2004

Related U.S. Application Data

(63) Continuation-in-part of application No. 10/041,669, filed on Jan. 10, 2002, now Pat. No. 6,921,163.

(30) Foreign Application Priority Data

| | | |
|---|---|---|
| Jan. 10, 2001 | (JP) | P2001-002338 |
| Jan. 17, 2001 | (JP) | P2001-009529 |
| Dec. 18, 2001 | (JP) | P2001-383975 |
| Apr. 9, 2003 | (JP) | P2003-105753 |

(51) Int. Cl.
*B41J 11/02* (2006.01)
*B41J 11/06* (2006.01)

(52) U.S. Cl. ..... 400/642; 347/104; 400/656; 400/648; 400/23; 400/48

(58) Field of Classification Search ..... None
See application file for complete search history.

(56) References Cited

U.S. PATENT DOCUMENTS

| | | | |
|---|---|---|---|
| 4,173,301 | A | 11/1979 | Turini et al. |
| 4,998,715 | A | 3/1991 | Milan et al. |
| 5,923,942 | A | 7/1999 | Nuggehalli et al. |
| 6,092,894 | A | 7/2000 | Nuita et al. |

FOREIGN PATENT DOCUMENTS

| | | |
|---|---|---|
| EP | 0 314 167 A2 | 5/1989 |
| EP | 0 997 306 A1 | 5/2000 |
| EP | 1 063 192 | 12/2000 |
| JP | 53-104073 A | 9/1978 |
| JP | 63-48221 | 4/1980 |
| JP | 58-011405 | 1/1983 |
| JP | 59-043751 | 3/1984 |
| JP | 60-19637 | 1/1985 |
| JP | 64-038369 | 2/1989 |
| JP | 03-251473 | 11/1991 |

(Continued)

OTHER PUBLICATIONS

Patent Abstract of Japan 55-055662.

(Continued)

*Primary Examiner*—Daniel J. Colilla
(74) *Attorney, Agent, or Firm*—Sughrue Mion, PLLC

(57) ABSTRACT

There are provided a suction unit which sucks a recording medium, and a unit which changes sucking force of the suction unit according to the property of the recording medium. Hereby, since the sucking force of the suction unit can be set according to a state of the recording medium. Therefore, for example, even if the recording medium is greatly curled, since its recording medium can be surely sucked on the transporting surface of the recording medium by the suction unit. Further, even if the recording medium has little rigidity and is thin, it is possible to prevent the recording medium from being stuck on the transporting surface of the recording medium by the suction unit.

8 Claims, 21 Drawing Sheets

FOREIGN PATENT DOCUMENTS

| | | | |
|---|---|---|---|
| JP | 10035943 A | * | 2/1998 |
| JP | 11-007139 | | 1/1999 |
| JP | 11-091293 | | 4/1999 |
| JP | 2000-318870 | | 11/2000 |

OTHER PUBLICATIONS

Patent Abstract of Japan 64-038369.
Patent Abstract of Japan 03-251473.
Patent Abstract of Japan 11-007139.
Patent Abstract of Japan 2000-318870.
Patent Abstract of Japan 11-091293.
Chinese Office Action dated Feb. 27, 2004 for Application No. 02105263.8.

* cited by examiner

RECORDING APPARATUS

The present application is a continuation in part application of U.S. patent application Ser. No. 10/041,669 filed on Jan. 10, 2002, now U.S. Pat. No. 6,921,163 which is incorporated herein by reference.

BACKGROUND OF THE INVENTION

The present invention relates to a recording apparatus which records data on a recording medium, and particularly to a recording apparatus in which suction of the recording medium is devised.

Generally, in a large-sized printer that is one of conventional recording apparatuses, a sheet feeding portion for feeding a recording medium, for example, printing roll sheet, a printing unit for printing data on the fed roll sheet, and a sheet discharging portion for discharging the printed roll sheet are arranged in this order from the upper part. In case that this large-sized recording apparatus, for example, an ink jet printer is used, a user houses a roll sheet in the sheet feeding portion and pulls out a leading end of the roll sheet. And, the user lets the leading end of the roll sheet pass through a flat sheet feeding guide that functions as a sheet transporting surface, and then interposes it between a sheet feeding roller and a driven roller to start the printer.

Then, the ink jet printer, while it rotates the sheet feeding roller and feeds out the roll sheet on a flat platen that functions as a sheet transportation guide surface, ejects ink droplets from a nozzle opening of a printing head and prints data on the roll sheet. Thereafter, the printer rotates the discharging roller and discharges the roll sheet to the outside through a flat sheet discharging guide that functions as a sheet transporting surface.

In such the conventional printers, in order to prevent the curled roll sheet from rising after printing, there is provided a sheet suction portion which sucks the roll sheet between the platen and the sheet discharging guide. In this sheet suction portion, plural suction ports are provided in the direction perpendicular to the transporting direction of the roll sheet, i.e., in the main scanning direction, and in the transporting direction of the roll sheet, i.e., in the sub-scanning direction; and fans for sucking the outside air from each suction ports are included.

However, in case that many suction ports are provided as described above, the suction capacity of the fans decrease in case the number of the arranged fans is limited and particularly the leading end of the greatly curled roll sheet cannot be sucked reliably. While reduction of the number of the suction ports resolves this problem, some suction ports are required since the roll sheet is large, so that it is difficult to balance the number of the suction ports with the suction capacity of the fans.

Generally, a sheet has the property of curving easily due to absorption. Particularly, in case that the large-sized roll sheet, for example, a wide roll sheet of A0 size or B0 size in JIS (Japanese Industrial Standard) is curved, rising of the roll sheet is easy to be produced on the platen in the printing unit, so that there is fear that printing accuracy cannot be kept. Therefore, the suction unit is provided in order to suck the roll sheet on the sheet transporting surface, whereby the rising of the roll sheet on the platen is prevented and the printing accuracy is secured.

However, when the roll sheet is curled greatly, it cannot be sucked on the sheet transporting surface by the suction unit. Particularly, when such the roll sheet is set, the leading end of the roll sheet does not frequently pass through the discharging roller. Further, when the roll sheet has little rigidity and is thin, it is stuck onto the sheet transporting surface by the suction unit. Particularly, when such the roll sheet is set, it cannot be moved to its set position.

Further, not only in the large-sized printers which carries out recording on a roll sheet, but also in normal inkjet printers, when a large number of ink droplets are ejected on a sheet, for example, a solid image is recorded on the sheet, the sheet absorbs a large amount of ink and is swollen like a wave onto a recording head side after the recording, that is, cockling is generated. When the cockling is generated and grown, an interval between the sheet and the recording head becomes nonuniform so that the flight distance of the ink droplet is varied to cause a recording unevenness or the sheet comes in contact with the recording head and is thus contaminated. In recent years, there has been proposed an ink jet printer for forming, on a sheet transportation surface, a plurality of holes at a constant pitch in a sheet transporting direction and a direction perpendicular thereto, that is, a plurality of grid-like holes and sucking a sheet by means of a sucking pump through these holes, thereby suppressing the cockling (see JP-A-63-303781 and JP-A-3-270).

In the conventional ink jet printer comprising a sucking type sheet transportation apparatus, a sucking drag to be a transportation resistance of a recording medium which is generated by a suction is changed due to a variation in the area of a sheet covering the hole or a difference in a coefficient of friction for each type of the sheet so that the transportation amount of the sheet is varied, resulting in a deterioration in recording precision in some cases.

SUMMARY OF THE INVENTION

The invention has been made in view of the above problems, and its object is to provide a recording apparatus which can surely suck a recording medium.

Further, another object of the invention is, in view of the above problems, to provide a recording apparatus which can control the degree of suction of a recording medium.

The invention is also related to provide a recording medium transportation device capable of enhancing precision in the transportation of a recording medium, and a recording apparatus comprising the recording medium transportation apparatus.

In order to achieve the object, according to the first aspect of the invention, in a recording apparatus which records data on a recording medium, there is provided a suction unit having plural suction ports for sucking a recording medium that has been already recorded, which are provided in the transporting direction of the recording medium. When the recording medium does not come to be transported, the suction ports are closed, and when the recording medium comes to be transported, the suction ports are sequentially opened according to transportation of the leading end of the recording medium.

Hereby, when the recording medium that has been recorded comes to be transported, only the suction ports in a portion where the leading end of the recording medium is located can be opened. Therefore, it is possible to concentrate the suction capacity of fans on the opened suction ports, and particularly the leading end of the greatly curled recording medium can be sucked surely.

According to the second aspect of the invention, in the recording apparatus according to the first aspect, the suction ports are opened and closed by a shutter. Accordingly, by only synchronizing the transportation of the recording medium with the opening operation of the shutter, the operation of opening the suction ports sequentially according to the transportation of the leading end of the recording medium can be readily performed.

According to the third aspect of the invention, in the recording apparatus according to the second aspect, the shutter is operated by a cam mechanism. Hereby, the opening and closing of the suction ports can be surely performed by a simple mechanism.

According to the fourth aspect of the invention, in the recording apparatus according to the second or third aspect, the shutter has holes corresponding to the suction ports. Accordingly, by only coinciding the suction port with the hole, the suction port can be opened, and by only shifting the suction port from the hole, the suction port can be closed.

According to the fifth aspect of the invention, in the recording apparatus according to the fourth aspect, the hole on the upstream side of the transportation of the recording medium is formed longer than the hole on the downstream side of the transportation. Hereby, since the suction port corresponding to the long hole can be opened for a longer time than other suction ports corresponding to the smaller holes than the long hole, the operation of opening the suction ports sequentially according to the transportation of the leading end of the recording medium can be readily performed.

In order to achieve another object, according to the sixth aspect of the invention, in a recording apparatus which records data on a recording medium, there are provided a suction unit which sucks a recording medium that has been already recorded and a unit which changes the sucking force of the suction unit according to the property of the recording medium. Hereby, since the sucking force of the suction unit can be set according to a state of the recording medium, for example, even if the recording medium is greatly curled, its recording medium can be surely sucked on the transporting surface of the recording medium by the suction unit. Further, even if the recording medium has little rigidity and is thin, it is possible to prevent its recording medium from being stuck onto the transporting surface of the recording medium by the suction unit.

According to the seventh aspect of the invention, in the recording apparatus according to the sixth aspect, the sucking force of the suction unit is changed so as to become larger as the recording medium becomes thicker. Hereby, even if the transporting surface of the recording medium is formed slantingly, a thick recording medium, i.e., a heavy recording medium can be surely sucked on the transporting surface by the large sucking force. Therefore, it is possible to prevent such the recording medium from slipping on the transporting surface and falling.

According to the eighth aspect of the invention, in the recording apparatus according to the sixth or seventh aspect, the unit which changes the sucking force of the suction unit is an operation unit which a user can operate. Hereby, the user can control the suction of the recording medium with his own eyes, or can control it automatically by the recording apparatus.

According to the ninth aspect of the invention, in the recording apparatus according to the eighth aspect, the operation unit is a feeding key of the recording medium in an operation panel. Hereby, since it is not necessary for the user to separate his hand from the operation panel, the sucking force of the suction unit can be set quickly and readily.

According to the tenth aspect of the invention, in the recording apparatus according to the eighth or ninth aspect, the operation unit can perform an operation of changing the sucking force of the suction unit by multi-step. Hereby, the suction of many kinds of recording media on the transporting surface can be surely performed.

According to the eleventh aspect of the invention, in the recording apparatus according to any one of the eighth to tenth aspects, the operation unit is available when the recording medium is set. Hereby, for example, even if the recording medium is greatly curled, since its recording medium can be surely sucked on the transporting surface of the recording medium by the suction unit, the leading end of the recording medium is allowed to pass through the discharging roller. Further, even if the recording medium has little rigidity and is thin, since it is possible to prevent its recording medium from being stuck onto the transporting surface of the recording medium by the suction unit, the recording medium can be advanced to its set position.

According to the twelfth aspect of the invention, the recording apparatus according to any one of the first to fifth aspects includes the unit of changing the sucking force of the suction unit according to any one of the sixth to eleventh aspects. Hereby, the recording apparatus having the above working effects can be constituted.

According to the another aspect the invention, in the recording apparatus according to the aspects, the suction unit includes a plate member constituting a suction portion on a transportation surface of the recording medium and having a plurality of suction ports, a shutter provided under the plate member having a plurality of holes corresponding to the suction ports, and a fan for generating a sucking force on the suction ports, wherein the shutter opens and closes the suction ports by relatively moving with respect to the plate member.

Further the suction ports may be constituted by at least two rows of the suction ports, the suction ports in each row are arranged substantially perpendicular to a transportation direction of the recording medium, the holes formed on the shutter are constituted by at least two rows of the holes correspondingly to the suction ports, and the holes in a row provided on an upstream side of the transportation of the recording medium are formed longer than the holes in a row provided on a downstream side of the transportation of the recording medium.

The invention also provides a recording medium transportation apparatus for sucking and transporting a recording medium supplied onto a recording medium transportation surface, wherein a transportation amount of the recording medium is corrected in accordance with a sucking drag. Consequently, the transportation amount of the recording medium can be always maintained to be constant. Thus, it is possible to carry out recording with high precision.

The sucking drag may be calculated based on a size of the recording medium. Moreover, the sucking drag may be calculated based on a property of the recording medium. The property of the recording medium in the present invention includes thickness, material, surface treatment etc. of the recording medium. The size of the recording medium can be also interpreted as one of the properties. Furthermore, the sucking drag may be calculated based on a transportation position of the recording medium. Consequently, it is possible to particularly enhance precision in transportation corresponding to the case in which there is a high possibility that the sucking drag might be changed.

The above recording medium transportation device may be installed in a recording apparatus, for example. Consequently, it is possible to provide a recording apparatus producing each of the functions and advantages.

Information about the size and properties of the recording medium is obtained from an input by an user through an operation panel or the like. Further, the user may set the information in an external system such as a computer and may transmit it to the recording apparatus.

Alternatively, the size and properties of the recording medium may be detected by detection unit provided at a feeding portion etc. of the recording apparatus. More specifically, an optical detection unit provided with a light emission part and a photodector is applied for detecting a thickness of the recording medium. Inserting the recording medium between the light emission part and the photodetector, optical transmission through the recording medium can be measured. The recording medium is identified based on the measured optical transmission amount. A table determining the sort of the recording medium based on a range of the measured optical transmission amount may be provided in an external apparatus such a printer and a computer.

The invention is also directed to a controlling method for transporting a recording medium, including the steps of obtaining a sucking drag according to the recording medium and correcting a transportation amount of the recording medium based on the sucking drag.

DETAILED DESCRIPTION OF THE PREFERRED EMBODIMENT (First Embodiment)

First embodiment of the invention will be described below in detail with reference to drawings.

Figure 1:
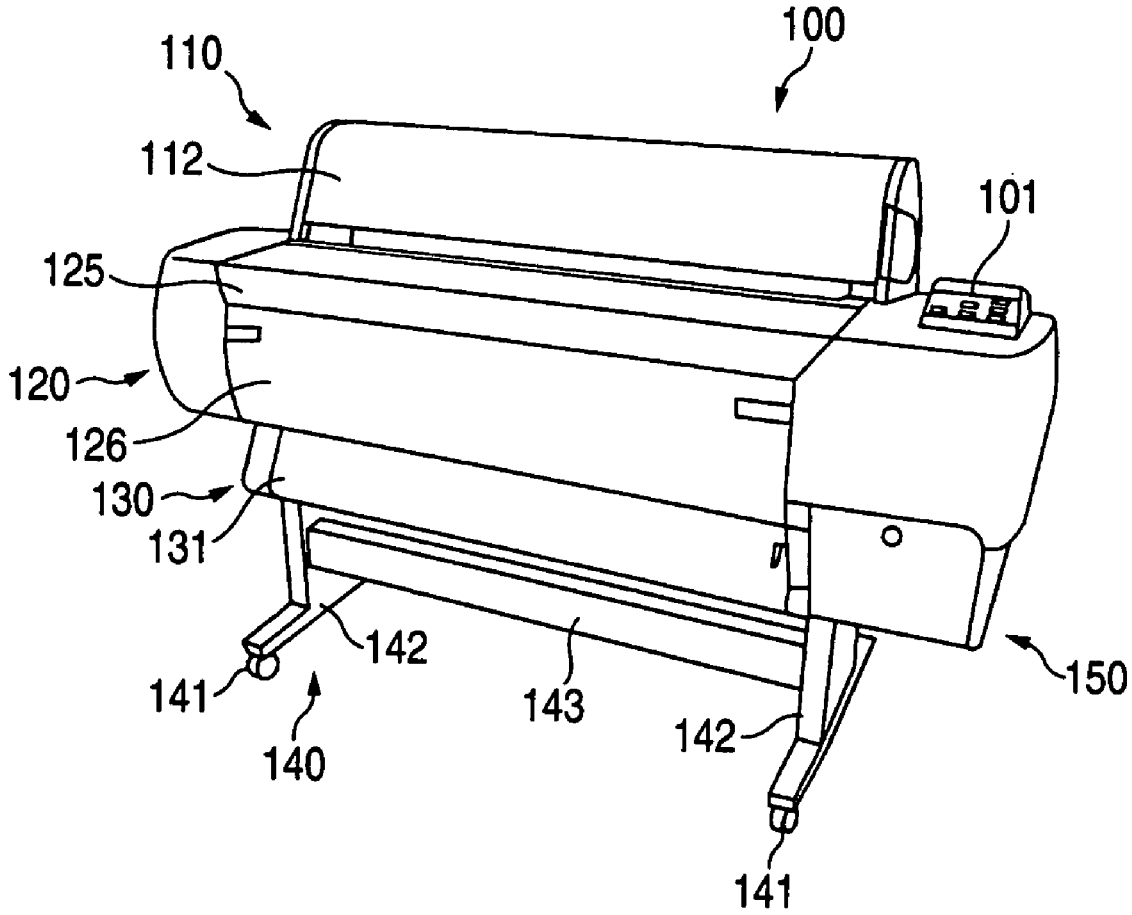
FIG. 1 is a perspective view showing a constitutional example of a printer according to the first embodiment of the invention.
Figure 2:
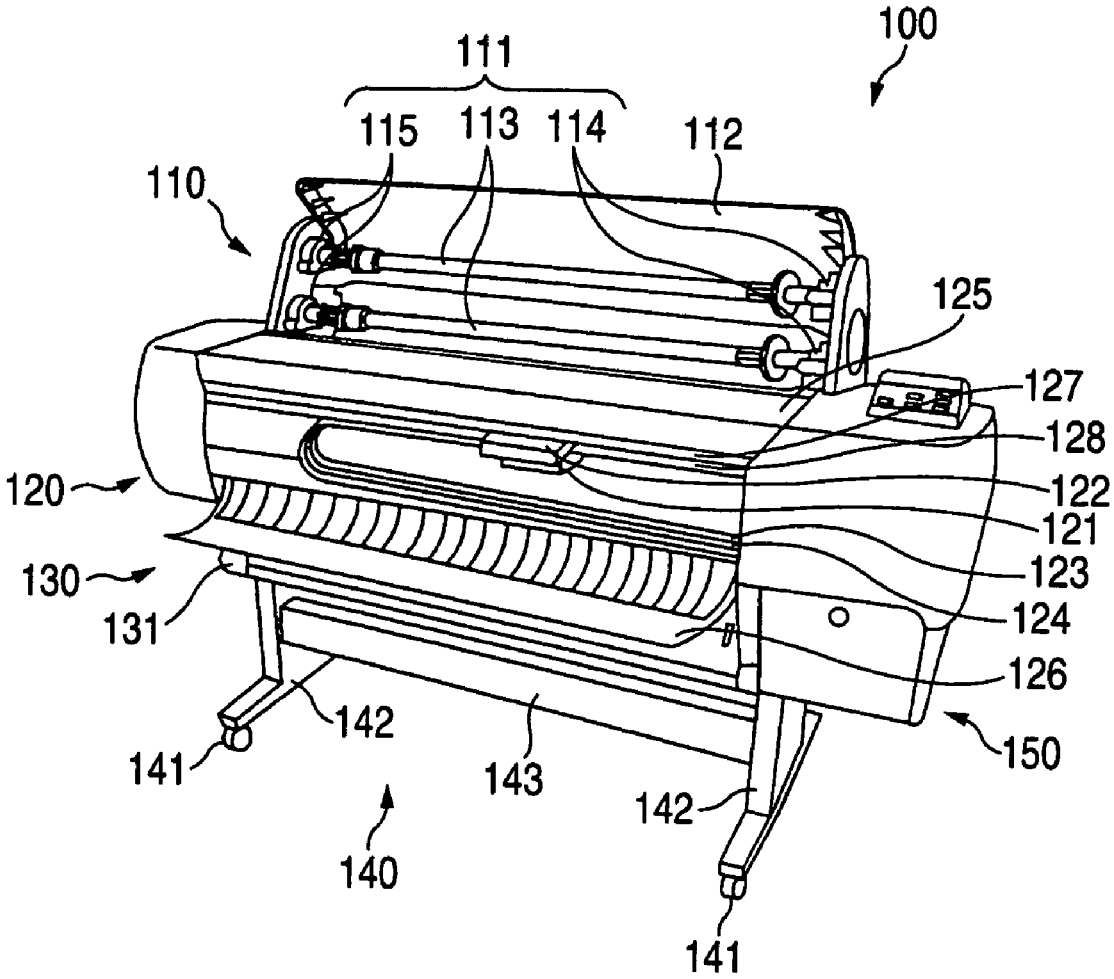
FIG. 2 is a perspective view showing an example of the inner constitution of a main portion of the printer in FIG. 1.

FIG. 1 is a perspective view showing a constitutional example of an ink jet printer that is a recording apparatus according to the embodiment of the invention, and FIG. 2 is a perspective view showing an example of the inner constitution of a main portion of its ink jet printer. An inkjet printer 100 shown in FIGS. 1 and 2 is a large-sized printer which can print data on a comparatively large-sized printing sheet, for example, a printing sheet of A0 size or B0 size in JIS. In this printer, a sheet feeding portion 110, a printing unit 120, a sheet discharging portion 130 and a leg portion 140 are arranged in this order from the upper part. The printing unit 120 and the sheet discharging portion 130 are integrated as a main body, and the sheet feeding portion 110 and the leg portion 140 are separably constituted.

The sheet feeding portion 110, as shown in FIG. 1, is provided so as to project toward the upper backside of the main body 120, 130. Inside the sheet feeding portion 110, as shown in FIG. 2, a roll sheet holder 111 in which two roll sheets (printing sheet) can be slantingly set up and down is provided. In the front of the sheet feeding portion 110, as shown in FIGS. 1 and 2, a spring type roll sheet cover 112 that can be opened or closed is attached so as to cover the roll sheet holder 111.

The roll sheet holder 111, as shown in FIG. 2, has spindles 113 for holding the roll sheet, and pairs of spindle receivers 114 and 115 attached on inner surfaces of both sidewalls of the sheet feeding portion 110. The spindles 113 can be detachably attached to the spindle receivers 114 and 115. And, the spindle 113, after the roll sheet has been attached in the center of the spindle, is attached to the spindle receiver 114 (115) at its both ends and rotatably supported. The roll sheet cover 112, as shown in FIGS. 1 and 2, its upper portion is rotatably supported, and the cover 112 is opened or closed by holding up or pushing down its lower portion.

The printing unit 120, as shown in FIG. 2, comprises a carriage 122 provided with a printing head 121, a flexible flat cable (hereinafter referred to as FFC) that connects the printing head 121 and a control unit for executing printing (not shown), an ink tube 124 that connects the printing head 121 and an ink cartridge (not shown) which is filled with ink, a sheet feeding roller (not shown) that transports the roll sheet in the sub-scanning direction, and a sheet sucking unit (not shown) that prevents the roll sheet from rising. Onto the upper surface and the front surface of the printing unit 120, as shown in FIGS. 1 and 2, an upper cover 125 and a front cover 126 are attached so as to cover the printing head 121 and the carriage 122.

The printing head 121 includes a black ink printing head that ejects black ink and plural color ink printing heads that eject each color of yellow, light cyan, cyan, light magenta, and magenta. And, the printing head 121 has pressure generating chambers and nozzle openings communicating with the pressure generating chambers, and the pressure generating chamber in which the ink is stored is pressurized at a predetermined pressure, whereby ink droplets of which sizes are controlled are ejected from the nozzle openings to the roll sheet.

The carriage 122, as shown in FIG. 2, is suspended from a rail 127 provided in the main scanning direction through rollers and coupled to a carriage belt 128. When the carriage belt 128 is operated by a carriage driving device (not shown), the carriage 122 cooperates with the movement of the carriage belt 128, and reciprocates while being guided by the rail 127.

The FFC 123, of which one end is connected to a connector of the control unit, and of which the other is connected to a connector of the printing head, sends a print signal from the control unit to the printing head 121. The ink tube 124 is provided for ink of each color, one end of each of the ink tubes is connected to the ink cartridge of each corresponding color through an ink pressure supplying unit (not shown), and the other end of the same is connected to the printing head 121 of each corresponding color.

The ink tube 124 sends the ink of each color pressurized by the ink pressure supplying unit from the ink cartridge to the printing head 121. The front cover 126, as shown in FIGS. 1 and 2, is rotatably supported at its lower portion, and opened or closed by holding up or pushing down its upper portion.

The sheet discharging portion 130, as shown in FIGS. 1 and 2, includes a sheet discharging guide 131 that constitutes a part of a passage on which the roll sheet is transported in the sub-scanning direction, and a sheet discharging roller (not shown) that transports the roll sheet in the sub-scanning direction. On the right side viewed from the front surface of the sheet discharging portion 130, as shown in FIGS. 1 and 2, there is provided a cartridge holder 150 in which the ink cartridges are housed.

The leg portion 140, as shown in FIGS. 1 and 2, includes two supports 142 having casters 141, and a reinforcing bar 143 laid between these supports 142. And, on the upper portions of the supports 142, the sheet feeding portion 110 and the main body 120, 130 are mounted and screwed.

Figure 3:
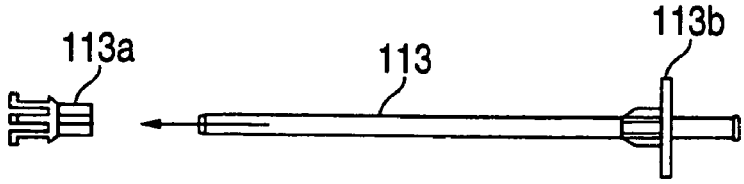
FIG. 3 is a first diagram showing a using procedure of the printer in FIG. 1.

Under this constitution, in case that the ink jet printer 100 is used, firstly the spindle 113 constituting the roll sheet holder 111 is taken out from the sheet feeding portion 110, and a roll sheet stopper 113*a* which is inserted to the spindle 113 is pulled out from one end of the spindle 113 as shown in FIG. 3.

Figure 4:
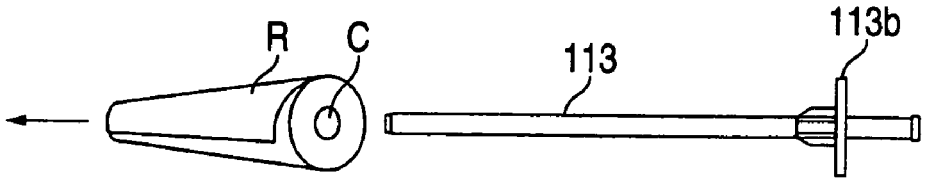
FIG. 4 is a second diagram showing the using procedure of the printer in FIG. 1.
Figure 5:
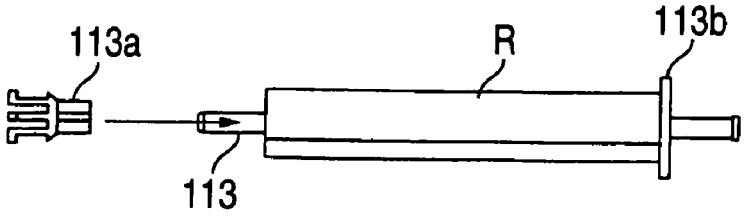
FIG. 5 is a third diagram showing the using procedure of the printer in FIG. 1.

Then, as shown in FIG. 4, one end of the spindle 113 is inserted into a roll sheet R from one end of an axial hole C of the roll sheet R till it passes through the axial hole, and as shown in FIG. 5, one end of the axial hole C of the roll sheet R is fitted to and brought into contact with a roll sheet stopper 113*b* inserted and fixed to the other end of the spindle 113. Next, the roll sheet stopper 113*a* is inserted from one end of the spindle 113 and fitted to the other end of the axial hole C of the roll sheet R. Hereby, the roll sheet R can rotate together with the spindle 113.

Figure 6:
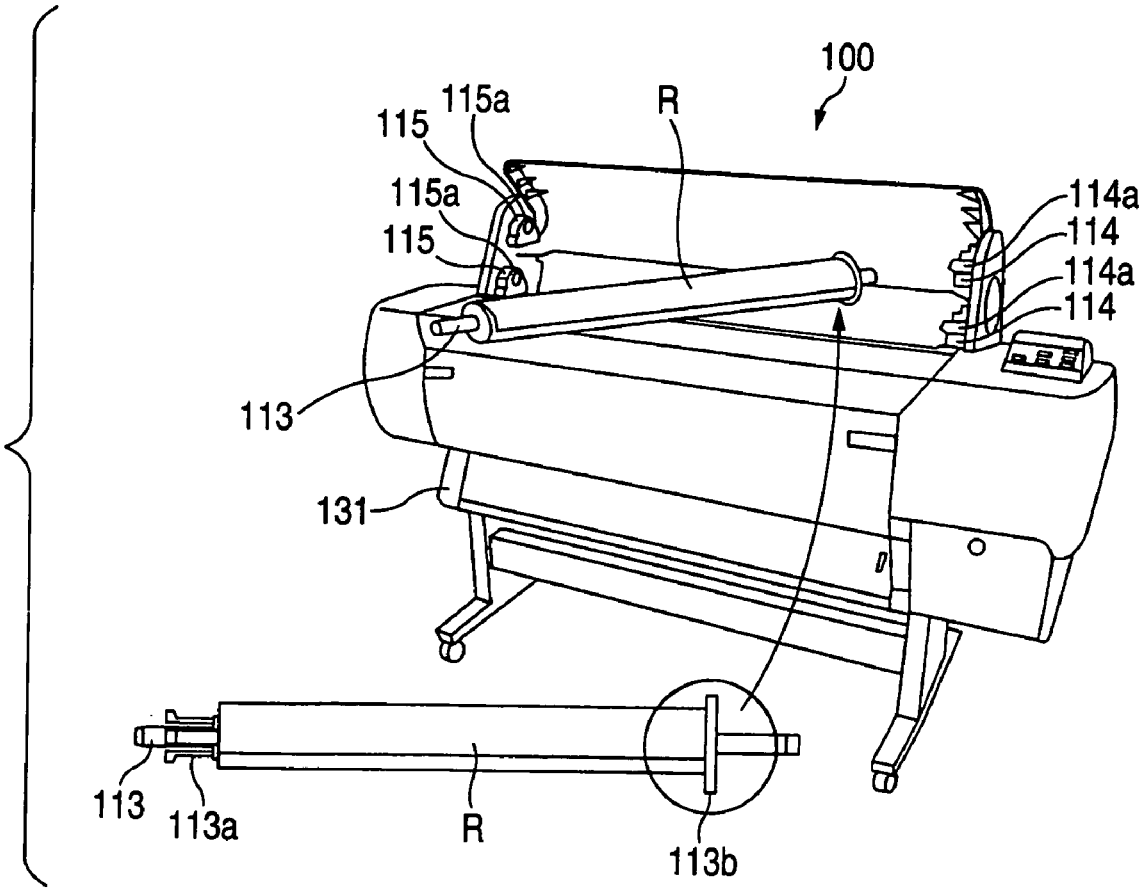
FIG. 6 is a fourth diagram showing the using procedure of the printer in FIG. 1.

Next, as shown in FIG. 6, the both ends of the spindle 113 to which the roll sheet R has been inserted are held and the spindle 113 is put in the state where it slants to backward and forward directions of the ink jet printer 100, i.e., the state where the other end of the spindle 113 to which the roll sheet R is inserted faces one spindle receiver 114.

Figure 7:
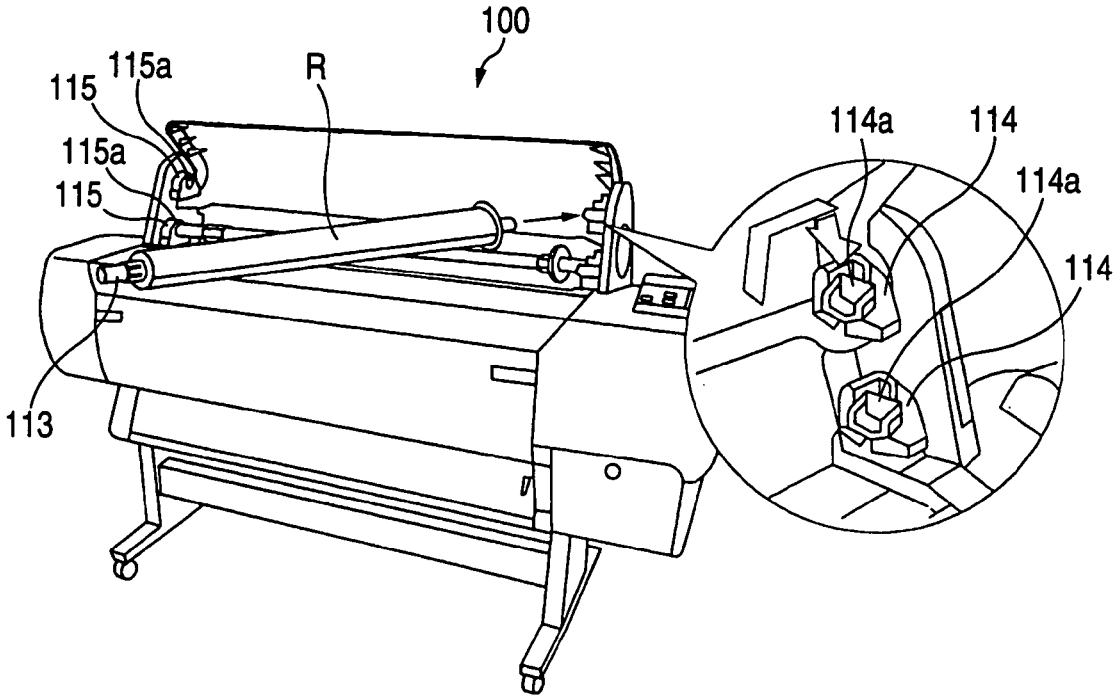
FIG. 7 is a fifth diagram showing the using procedure of the printer in FIG. 1.

Here, this spindle receiver 114 is constituted rotatably in the horizontal direction, and recesses 114*a* and 115*a* of the respective spindle receivers 114 and 115 that receives the ends of the spindle 113 are usually opposed to each other. However, when the spindle 113 to which the roll sheet R is inserted is set, as shown in FIG. 7, one spindle receiver 114 is turned to an angle of about 45 degrees to the other spindle receiver 115.

Thereafter, the other end of the spindle 113 to which the roll sheet R is inserted is fitted into the recess 114*a* of the one spindle receiver 114, and the spindle receiver 114 is turned together with the spindle 113 to which the roll sheet R is inserted. And, the recesses 114*a* and 115*a* of the spindle receivers 114 and 115 are opposed to each other and one end of the spindle 113 to which the roll sheet R is inserted is fitted into the recess 115*a* of the other spindle receiver 115. Hereby, the spindle 113 to which the roll sheet R is inserted can be readily set in the sheet feeding portion 110.

Figure 8:
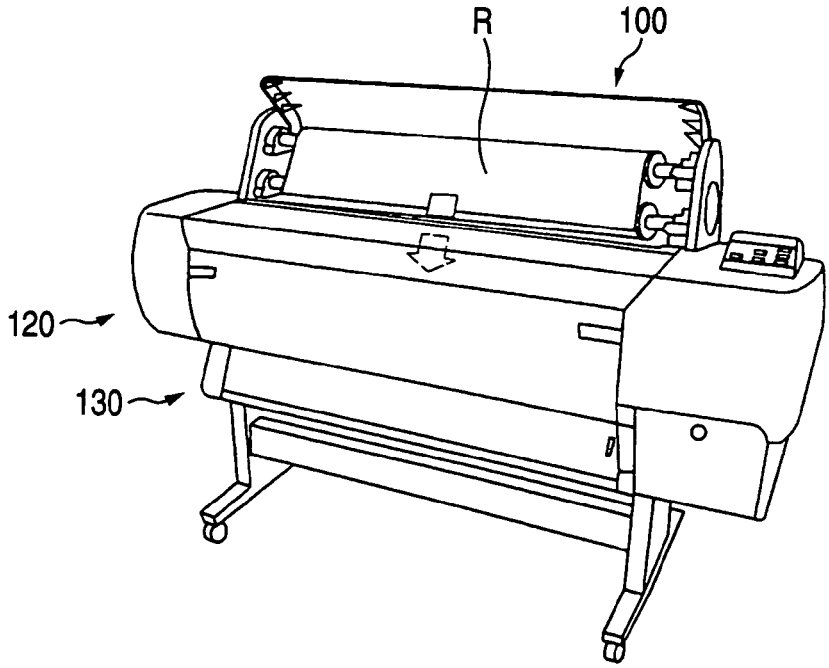
FIG. 8 is a sixth diagram showing the using procedure of the printer in FIG. 1.
Figure 9:
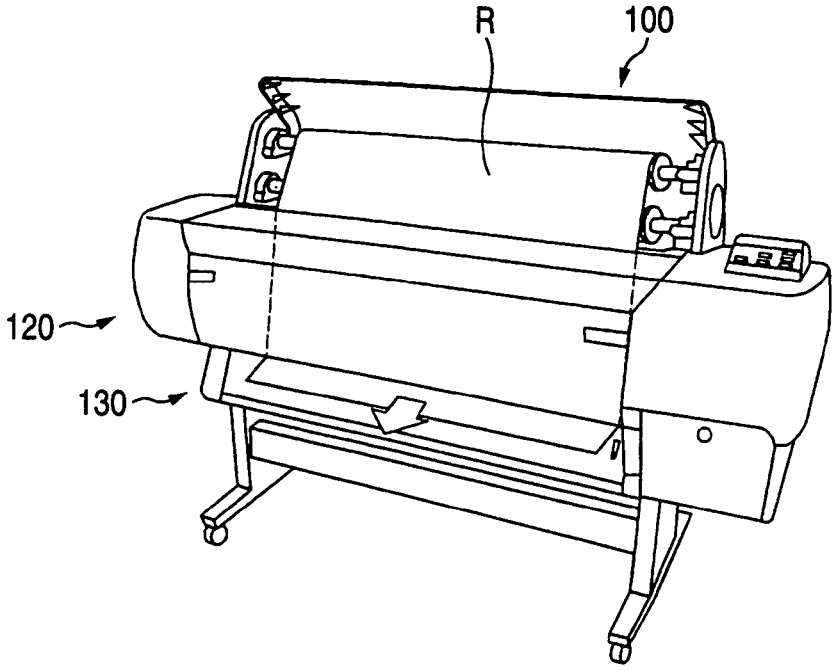
FIG. 9 is a seventh diagram showing the using procedure of the printer in FIG. 1.
Figure 10:
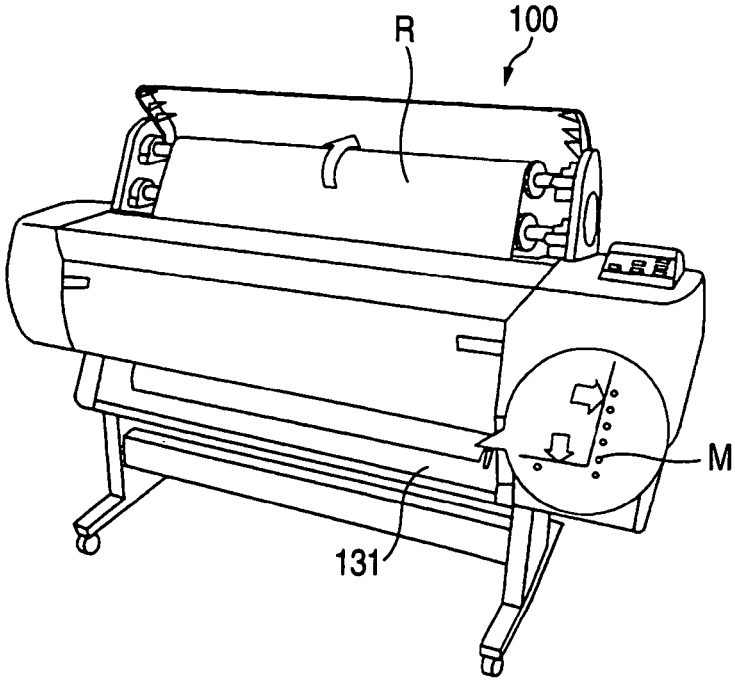
FIG. 10 is an eighth diagram showing the using procedure of the printer in FIG. 1.

Next, as shown in FIG. 8, the leading end of the roll sheet R is pulled out downward, allowed to pass through a transporting passage of the printing unit 120; and further allowed to pass through a transporting passage of the sheet discharging portion 130 as shown in FIG. 9. And, as shown in FIG. 10, the roll sheet R is rotated in the rolling direction and the leading end of the roll sheet R is positioned to a marker M formed in the sheet discharging guide 131. Thereafter, the ink jet printer 100 is started, and while the roll sheet R is fed in the sub-scanning direction and the printing head 121 is moved in the main scanning direction, ink droplets are ejected, whereby the predetermined data is printed on the roll sheet R and the printed roll sheet R is discharged.

Figure 11:
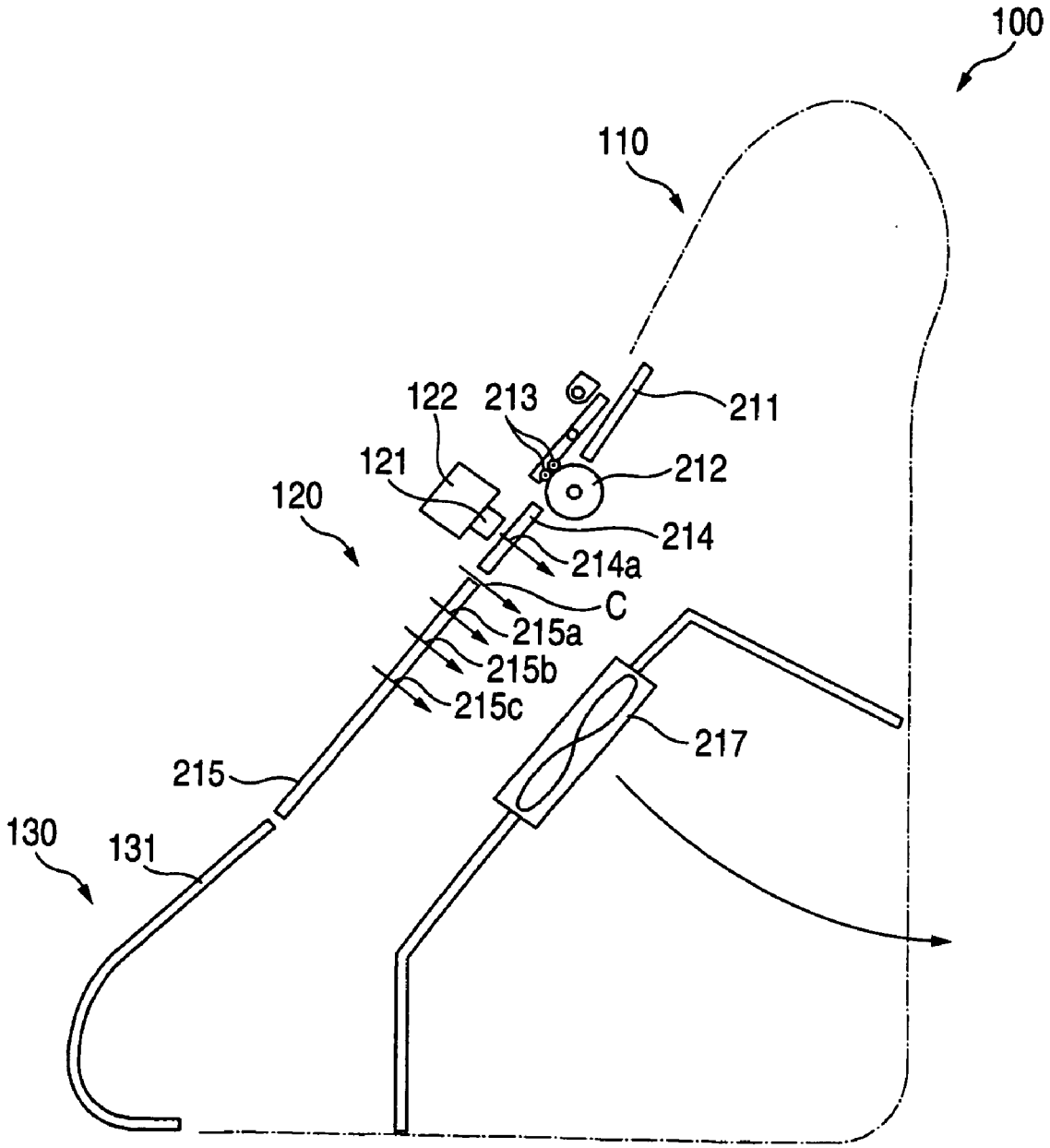
FIG. 11 is a schematic sectional side view, which shows a transporting surface of a roll sheet including a suction unit that is a characteristic portion of the first embodiment.
Figure 12:
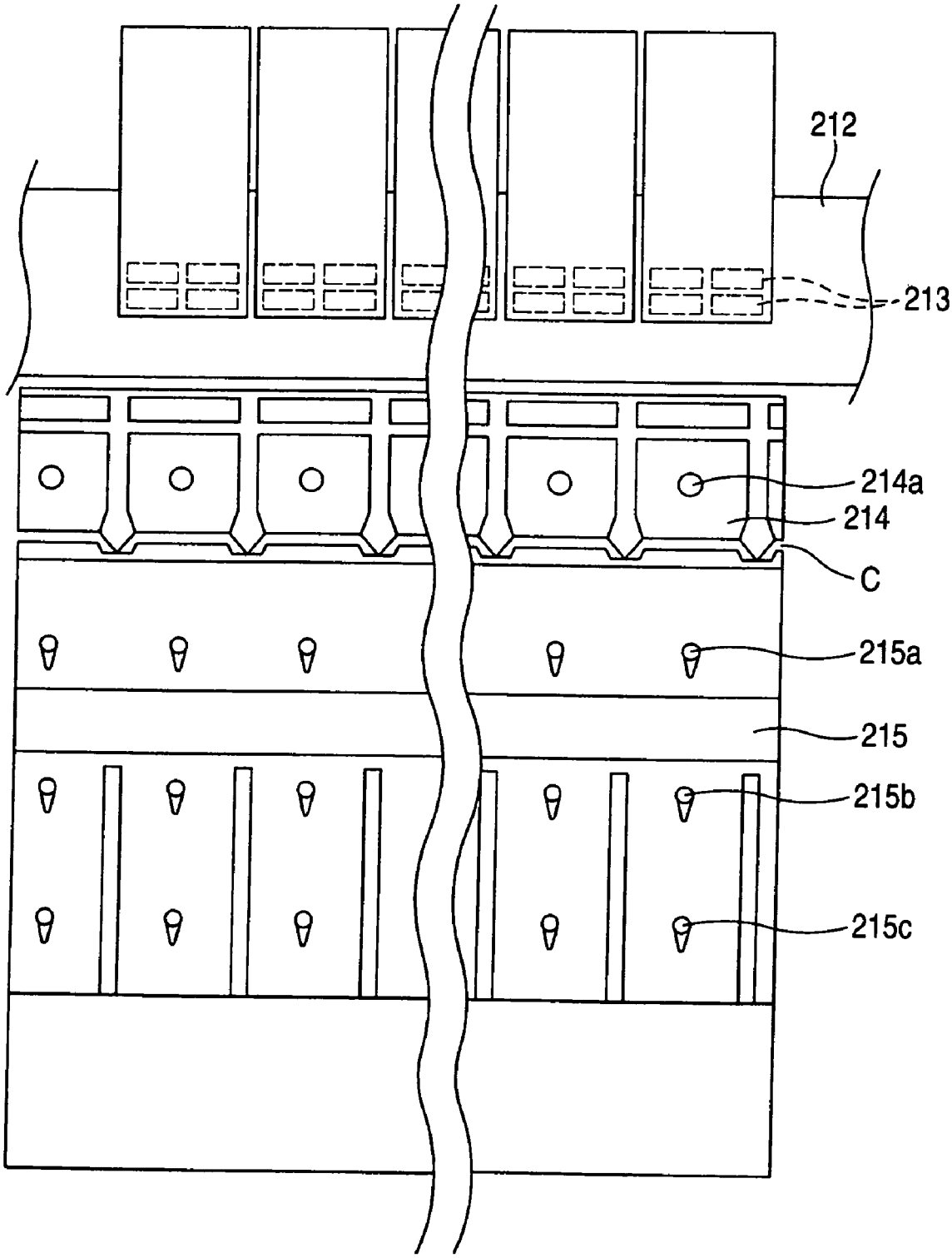
FIG. 12 is a plan view showing the circumference of a sheet transporting guide portion shown in FIG. 11.

FIG. 11 is a schematic sectional side view showing a transporting surface of the roll sheet including a suction unit that is a characteristic part of the first embodiment, and FIG. 12 is its plan view. The sheet transporting path extending from the sheet feeding portion 110 through the printing unit 120 to the sheet discharging portion 130 slants from the upper backside of the ink jet printer 100 to the lower front side thereof.

This sheet transporting path comprises a flat sheet feeding guide 211 provided from the sheet feeding portion 110 to the printing unit 120, a sheet feeding roller 212 and a driven roller 213 which are opposed to each other contactably and separably, a platen 214 functioning as a flat sheet transporting guide member that is opposed to the printing head 121 mounted on the carriage 122, a flat sheet sucking unit 215 provided from the printing unit 120 to the sheet discharging portion 130, and a sheet discharging guide 131 provided for the sheet discharging portion 130.

Each surface of the sheet feeding guide 211 and the sheet discharging guide 131 functions as a sheet transporting surface. The surface of the platen 214 functions as a sheet transporting guide surface and also as a sheet sucking surface. Namely, as shown in FIG. 12, the platen 214 has plural suction ports 214*a* arranged in the main scanning direction. The outside air is sucked from each suction port 214*a* by fans 217 that is provided inside the printing unit 120 as shown in FIG. 11, whereby the roll sheet transported on the platen 214 is sucked. Accordingly, even if the roll sheet is wide, the roll sheet is surely sucked on the platen 214 in whole at the printing time, so that printing accuracy can be kept high.

Further, as shown in FIG. 12, a gap C is provided between the platen 214 and the suction unit 215, and as shown in FIG. 11, the outside air is sucked from the gap C by the fans 217 that is provided inside the printing unit 120, whereby the roll sheet transported on the gap C is sucked. Accordingly, the roll sheet is sucked also between the platen 214 and the suction unit 215 at the printing time, and the roll sheet becomes flatter there than on the plate 214, so that printing accuracy can be kept higher.

The surface of the sheet sucking unit 215 functions as a sheet transporting surface and a sheet sucking surface. Namely, as shown in FIG. 12, the sheet sucking unit 215 has plural suction ports 215*a*, 215*b*, and 215*c*, which are arranged in the main scanning direction and arranged in three rows in the sub-scanning direction. As shown in FIG. 11, the outside air is sucked from each of the suction ports 215*a*, 215*b*, and 215*c* by the fans 217 that is provided inside the printing unit 120, whereby the roll sheet transported on the sheet sucking unit 215 is sucked.

In this suction unit 215, when the roll sheet does not come to be transported, all the suction ports 215*a*, 215*b* and 215*c* are closed. And, when the roll sheet comes to be transported, according to the transportation of the leading end of the roll sheet, the suction ports 215*a*, 215*b* and 215*c* are sequentially opened. Namely, the suction ports 215*a* on the transportation upstream side of the roll sheet are firstly opened, and then the suction ports 215*b* and 215*c* on the transportation downstream side of the roll sheet are opened.

Figure 13:
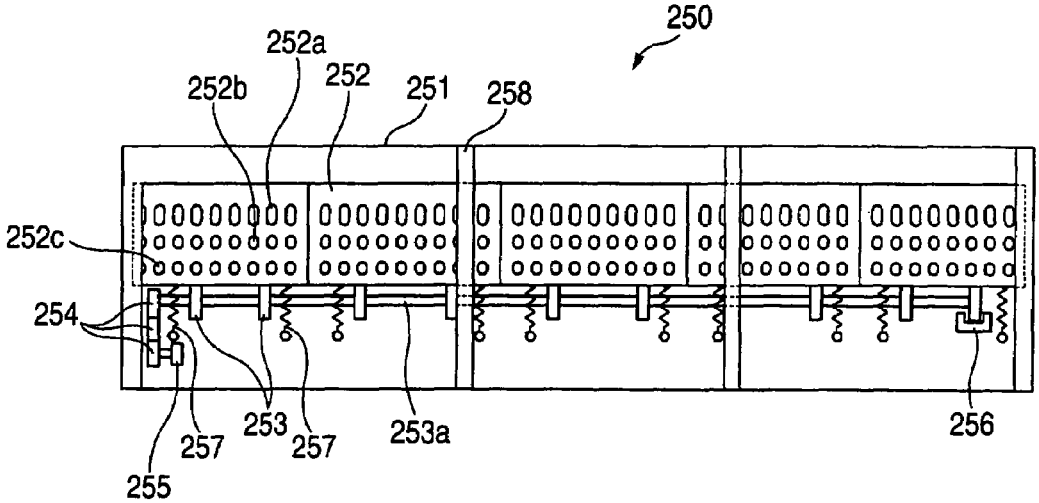
FIG. 13 is a plan view in which a suction unit shown in FIG. 11 is viewed from a back surface.

FIG. 13 is a plan diagram viewed from the backside of the suction unit 215. On the backside of the suction unit 215, an opening and closing mechanism for opening and closing the suction ports 215*a*, 215*b* and 215*c* is provided. This opening and closing mechanism 250 comprises a shutter 252 which is arranged in a housing 251 made of a sheet metal and cams 253 constituting a cam mechanism, a gear 254, a motor 255, a sensor 256, and tension springs 257.

Figure 14:
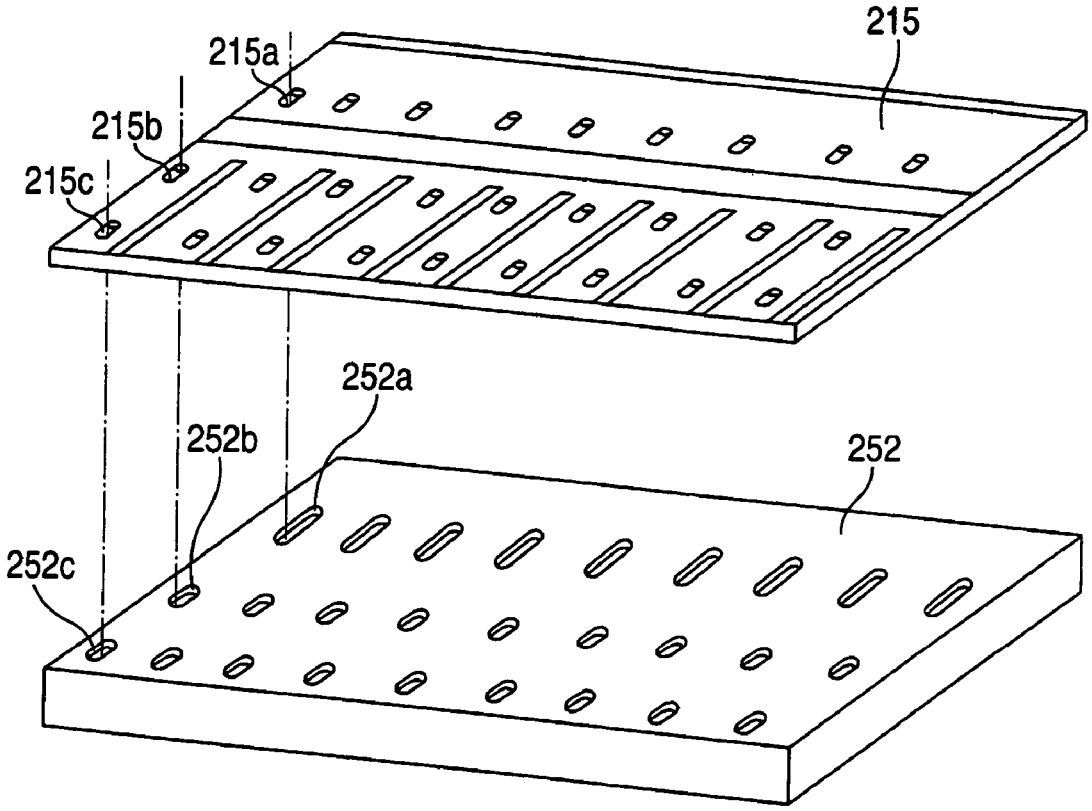
FIG. 14 is a perspective view showing the suction unit shown in FIG. 11 and a main portion of an opening and closing mechanism shown in FIG. 13.

The shutter 252 is formed in the shape of a plate, the plural shutters (in this embodiment, fives shutters) are arranged in the housing 251, and holes 252*a*, 252*b*, and 252*c* corresponding to the suction ports 215*a*, 215*b*, 215*c* of the suction unit 215 are formed in the shutter as shown in FIG. 14. The hole 252*a* on the transportation upstream side of the roll sheet is formed longer than the holes 252*b* and 252*c* on the transportation downstream side of the roll sheet.

The cams 253 are arranged so that the peripheries of two cams 253 come into contact with one end of each shutter 252 on the hole 252*c* side, and coupled to the motor 255 through the gear 254 arranged on one end side of a cam shaft 253*a*. This cam 253, as shown in FIGS. 15A, 15B and 15C, is formed so that it can move the shutter 252 in the arrangement direction of the holes 252*a*, 252*b*, and 252*c* by three steps (FIGS. 15A, 15B and 15C).

Figure 15A:
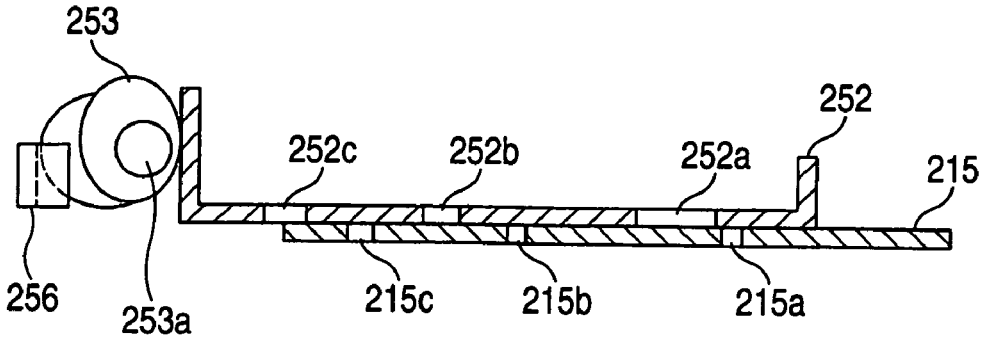
FIGS. 15A, 15B and 15C are side views showing the suction unit shown in FIG. 11 and an operating state of the main portion of the opening and closing mechanism shown in FIG. 13.
Figure 15B:
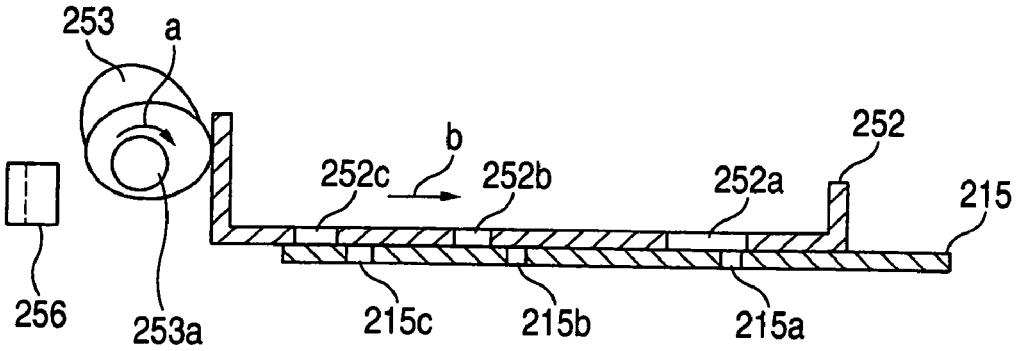
Figure 15C:
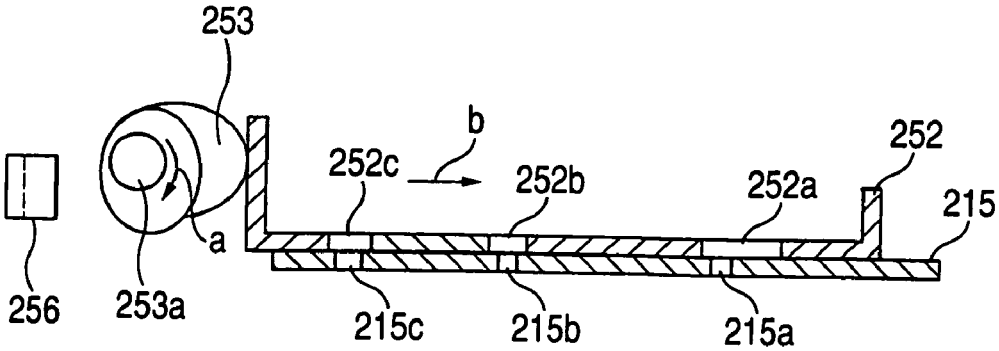

The sensor 256 is arranged in the vicinity of the cam 253 located on the other end side of the cam shaft 253*a*, and detects that the cam 253 is located in its home position, that is, in a position shown in FIG. 15A. One ends of two tension springs 257 are fitted to one end of each shutter 252 on the hole 252*c* side, and the other ends are fitted to the housing 251.

The inside of the housing 251 is partitioned into three rooms by partition plates 258 according to the number of the fans 217 (in this embodiment, three fans are arranged in the sub-scanning direction). This partition plate 258 is, in order to heighten the sealing effect of each room, formed of, for example, a sponge.

Under this constitution, when the roll sheet does not come to be transported to the suction unit 215, as shown in FIG. 15A, the cam 253 is located in the home position in the first step, and all the suction ports 215*a*, 215*b*, and 215*c* of the suction unit 215 are shifted from the holes 252*a*, 252*b*, and 252*c* of the shutter 252 and closed.

When the roll sheet comes to be transported to the suction unit 215 and immediately before the leading end of the roll sheet reaches the suction ports 251*a*, as shown in FIG. 15B, the cam 253 rotates in the direction of an arrow a by drive of the motor 255 and enters the second step. And, the cam 253 moves the shutter 252 in the direction of an arrow b, and only the suction port 215*a* of the suction unit 215 coincides with the hole 252*a* of the shutter 252 and is opened. The other suction ports 215*b* and 215*c* are shifted from the holes 252*b* and 252*c* and closed. Hereby, since the suction capacity of the fans 217 can be concentrated on the opened suction port 215*a*, the leading end of the greatly curled roll sheet can be surely sucked.

When the roll sheet 215 is further transported and immediately before the leading end of the roll sheet reaches the suction ports 215*b*, as shown in FIG. 15C, the cam 253 further rotates in the direction of the arrow a by the drive of the motor 255 and enters the third step. And, the cam 253 further moves the shutter 252 in the direction of the arrow b, and the suction ports 215*a*, 215*b*, and 215*c* of the suction unit 215 coincide entirely with the holes 252*a*, 252*b*, and 252*c* of the shutter 252 and are opened.

Since the suction port 215*a* corresponding to the hole 252*a* formed as a long hole can be kept open for a longer time than the other suction ports 215*b* and 215*c* corresponding to the smaller holes 252*b* and 252*c* than its long hole, the operation of opening the suction ports 215*a*, 215*b* and 215*c* sequentially according to the transportation of the leading end of the roll sheet can be readily performed.

According to the suction unit 215 having the above opening and closing mechanism 250, by only synchronizing the transportation of the roll sheet with the opening operation of the shutter 252, the operation of opening the suction ports 215*a*, 215*b* and 215*c* sequentially according to the transportation of the leading end of the roll sheet can be performed surely and readily by a simple mechanism such as the cam mechanism, so that the roll sheet can be transported while being sucked on the suction unit 215.

In the embodiment, the suction ports 215*a*, 215*b*, and 215*c* are provided in three rows. However, they may be provided in the arbitrary number of rows within the limits of the possible. Further, though the suction port 215*a* is firstly opened and then the suction ports 215*b* and 215*c* are simultaneously opened, the suction ports may be opened from the transportation upstream side of the roll sheet one by one.

Further, though the opening and closing mechanism 250 uses the cam mechanism, it is not limited to this but a gear mechanism may be used.

Figure 16:
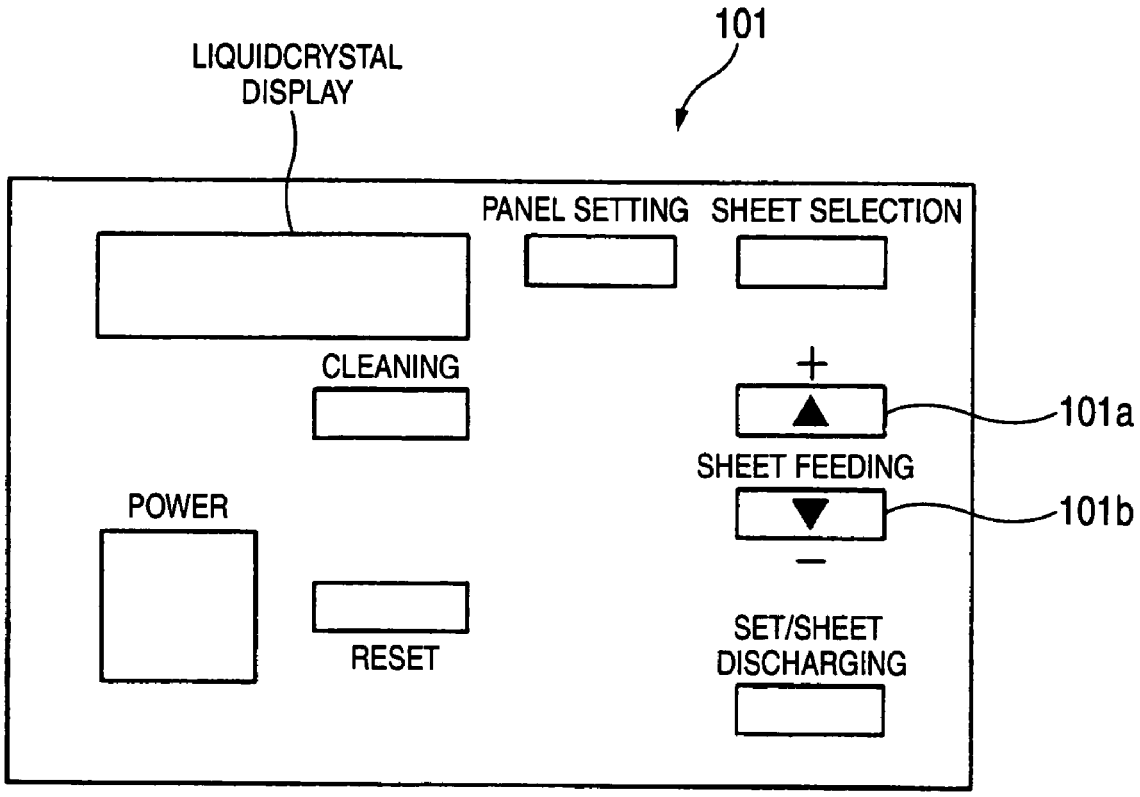
FIG. 16 is a diagram showing an operation panel which controls the sucking force of the suction unit in FIG. 11.

The fans 217 are constituted so that its sucking force can be controlled. Its control is set on an operation panel 101 arranged on a cartridge holder 150 located aside of the sheet feeding portion 110 shown in FIG. 1. Namely, as shown in FIG. 16, by pushing one of two "+" and "−" sheet feeding keys 101*a* and 101*b* arranged in the operation panel 101, the sucking force can be increased or decreased from the usual sucking force, for example, by three steps. When the sucking force of the fans 217 are thus controlled by multi-step, since it is not necessary for the user to separate his hand from the operation panel 101, the sucking force of the fans 217 can be set quickly and readily.

Figure 17:
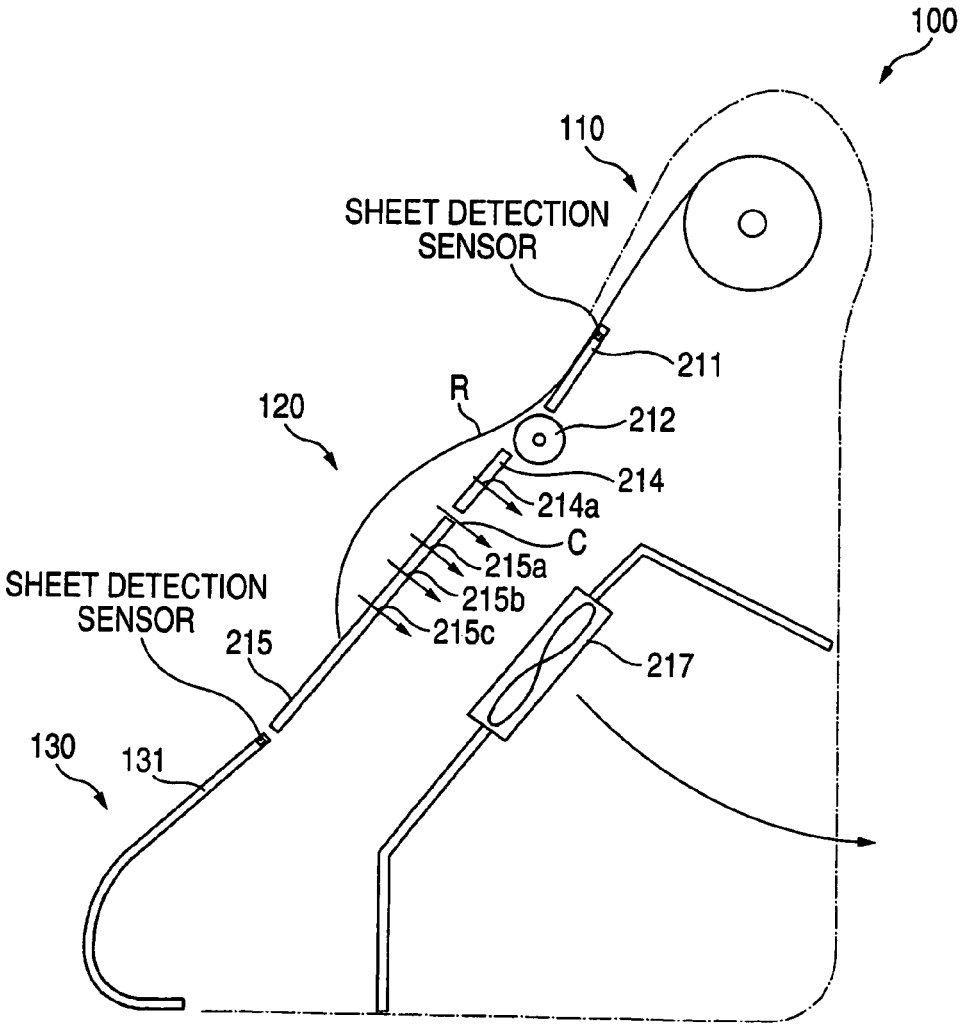
FIG. 17 is a first diagram showing a case where the sucking force of the suction unit in FIG. 11 must be controlled.

The sucking force of such the fans 217 are, when the roll sheet R is set, automatically set to a usual state, i.e., "MIDDLE". Accordingly, as shown in FIG. 17, even if the roll sheet R is greatly curled, the "+" sheet feeding key 101*a* is pushed to increase the sucking force of the fans 217, whereby the roll sheet R can be surely sucked on the sheet transporting surface by the fans 217, so that the leading end of the roll sheet R is allowed to pass through the discharging roller surely.

Figure 18:
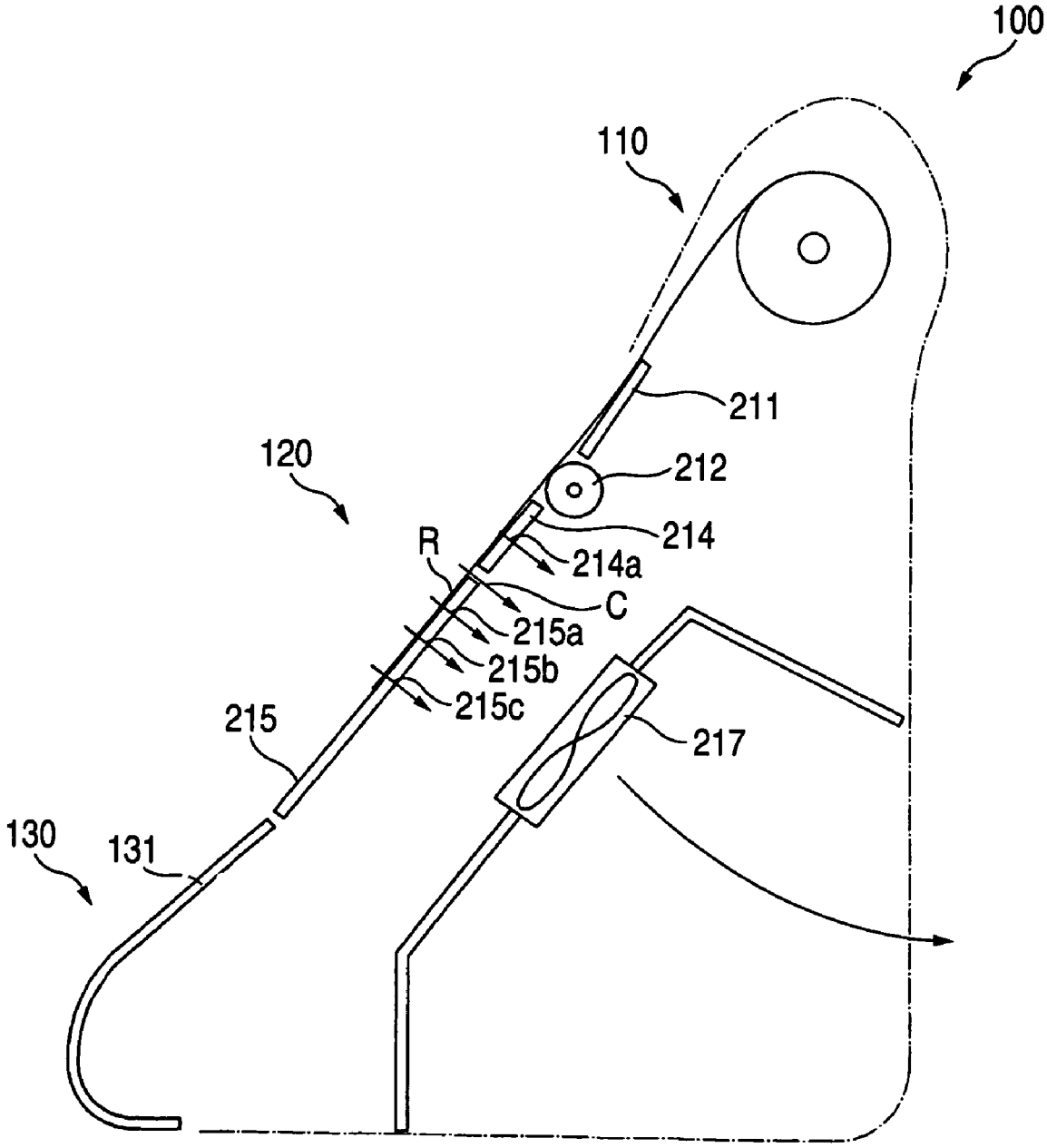
FIG. 18 is a second diagram showing the case where the sucking force of the suction unit in FIG. 11 must be controlled.

Further, as shown in FIG. 18, even if the roll sheet R has little rigidity and is thin, the "−" sheet feeding key 101*b* is pushed to decrease the sucking force of the fans 217, whereby it is possible to prevent the roll sheet R from being stuck on the sheet transporting surface by the fans 217, so that the roll sheet R can be advanced to its set position.

The control of the sucking force of the fans 217 according to the property of the roll sheet R, i.e., the operation of making the sucking force of the fans 217 small when the roll sheet R is thin and making the sucking force of the fans 217 large when the roll sheet R is thick is set on the operation panel by the user. However, the control of the sucking force is not limited to this.

For example, the user may input or select that the roll sheet R is a thick sheet or a thin sheet on the ink jet printer 100 or a computer connected to this printer. And, a CPU included in the ink jet printer 100 or the computer may judge its signal and change the sucking force of the fans 217.

A sucking drag, which implies the sucking force multiplied by a coefficient of friction of the roll sheet R and the transporting surface, varies in accordance with the suction force of the fan 217 and the property of the roll sheet R. At this time the transportation amount of the roll sheet R can be corrected in accordance with the sucking drag. Specifically, the sucking force of the fan is selected based on the size and property of the roll sheet R, and the sucking drag is calculated based on the sucking force. The transportation is controlled by correcting the transportation amount based on the calculated sucking drag. Further, the transportation may be controlled by calculating the sucking drag again based on the transportation position of the sheet R and correcting the transportation amount with the sucking drag thus calculated. Consequently, the transportation amount of the rolled sheet R can be always maintained to be constant. Thus, it is possible to carry out recording with high precision. Incidentally, the relationship between the sucking drag and the correction amount of the transportation will be described in more detail in the second embodiment below.

In the above embodiment, the suction ports 214*a* are provided for the platen 214 and the gap C is provided between the platen 214 and the suction unit 215 in order to suck the roll sheet. However, also in case that either of them is provided, the same effect is obtained. Further, as an example of the recording apparatus of the first embodiment, the printer has been explained. However, the invention is not limited to this but it can be applied to a recording apparatus having a suction unit of a recording medium, for example, a facsimile or a copying apparatus.

As described above, according to the recording apparatus of the first embodiment, when the recording medium that has been recorded comes to be transported, only the suction ports at the portion where the leading end of the recording medium is located are opened, whereby the suction capacity of the fans can be concentrated on the opened suction ports. Accordingly, the leading end of the greatly curled recording medium can be surely sucked.

Further, according to the recording apparatus of the first embodiment, the sucking force of the suction unit can be set according to the state of the recording medium. Therefore, for example, even if the recording medium is greatly curled, since its recording medium can be surely sucked on the transporting surface of the recording medium by the suction unit, the leading end of the recording medium is allowed to pass through the discharging roller. Further, even if the recording medium has little rigidity and is thin, it is possible to prevent the recording medium from being stuck on the transporting surface of the recording medium by the suction unit, so that the recording medium can be advanced to its set position.

(Second Embodiment)

Figure 19:
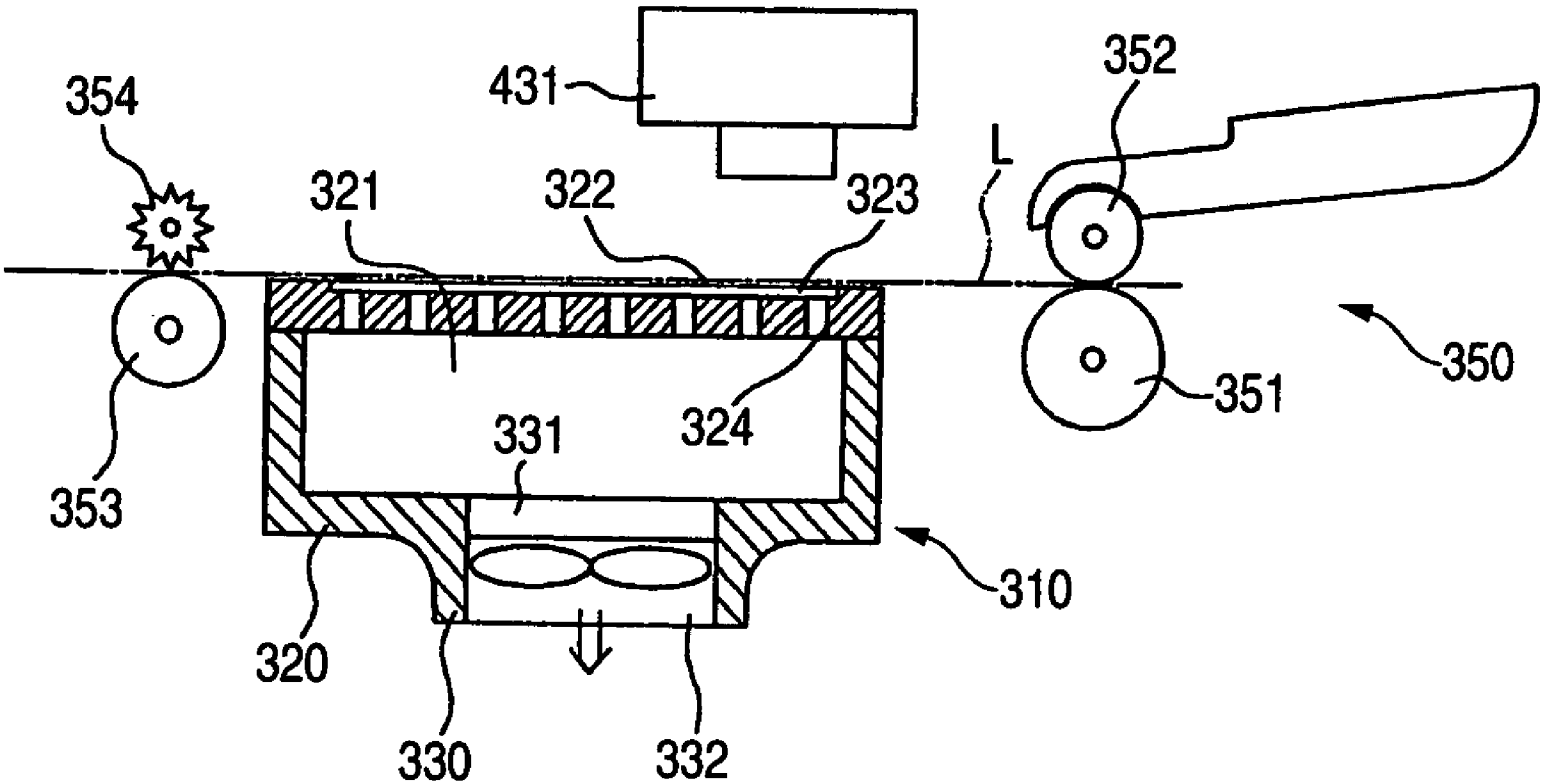
FIG. 19 is a side view showing a recording medium transportation device according to the second embodiment of the invention.

FIG. 19 is a sectional view showing a recording medium transportation device according to second embodiment for carrying out the invention. The recording medium transportation device 300 provides a sucking unit 310 sucking and keeping the recording medium at recording and a recording medium transporting mechanism 350 transporting the recording medium to the lower course side from the upper course side of the sucking unit 310. The above sucking unit 310 is arranged at lower side putting a recording medium carriage passage L to the recording head 431 for printing at the recording medium. The sucking unit 310 is formed in hollow box shape of construction of two stages, up and down, consisting of a sucking portion 320 of the upper stage and a sucking force generating portion 330 of the lower stage.

A sucking portion 320 has a pressure reducing chamber 321 formed in an inner part, a plurality of sucking chambers 323 formed, on a recording medium transporting surface 322, to be concave portions which take a long rectangular shape in the transporting direction of a recording medium, and a plurality of sucking holes 324 to be the characteristic portions of the invention which are extended in a vertical direction and have smaller circular sectional areas than the sectional areas of the sucking chambers 323 in order to cause the sucking chambers 323 to communicate with the pressure reducing chamber 321 respectively.

Figure 20A:
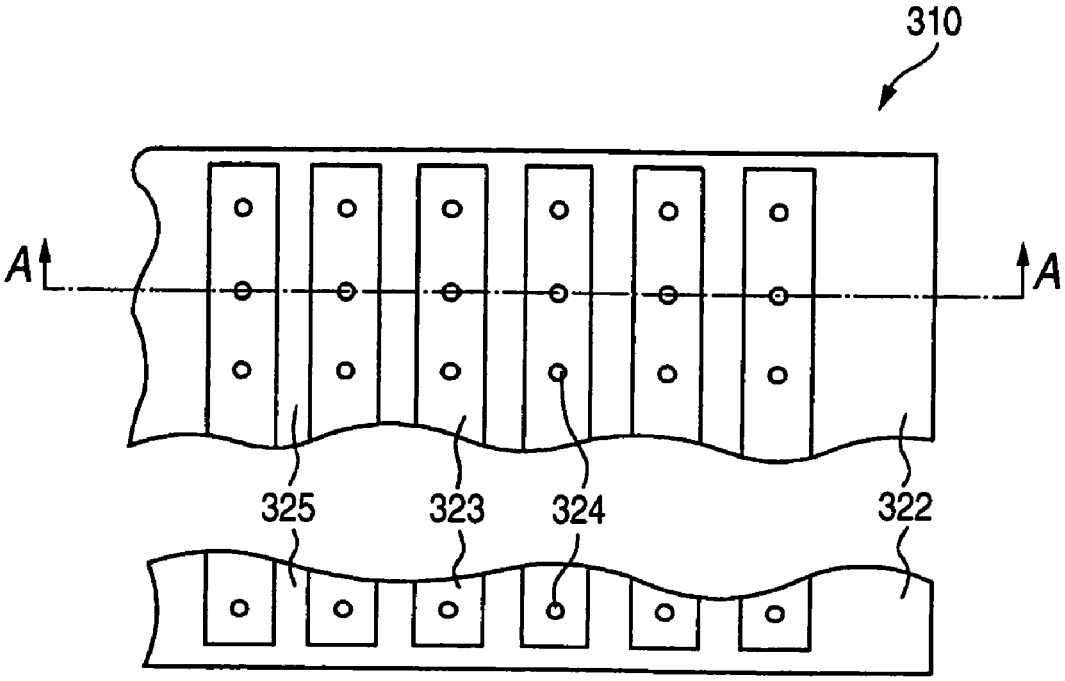
FIG. 20A is a plan view showing a sucking portion in FIG. 19
Figure 20B:
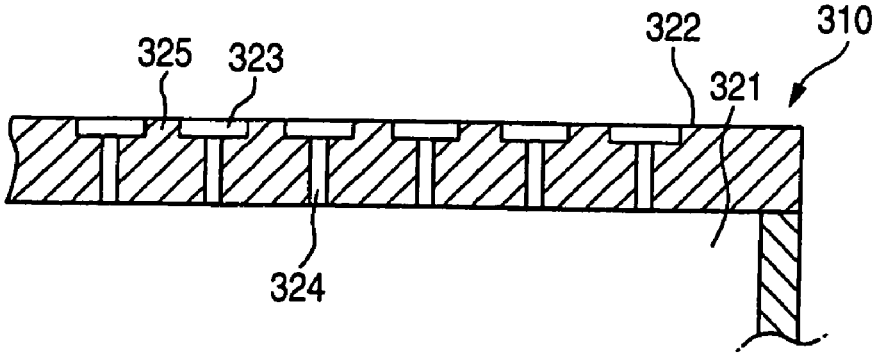
FIG. 20B is a sectional side view taken along an XXB—XXB line in FIG. 20A.

FIGS. 20A and 20B are a plan view showing the sucking portion 320 and a sectional side view taken along an XXB—XXB line. The sucking chamber 323 is formed in such a manner that a short side has a predetermined length and a long side has a length from the vicinity of an upstream end to the vicinity of a downstream end in the recording medium transporting surface 322. More specifically, the sucking chambers 323 are extended in communication with each other in the transporting direction of the recording medium and are arranged with a partition wall 325 interposed therebetween in a direction which is perpendicular to the transporting direction of the recording medium. The sucking hole 324 is formed on the bottom face of the sucking chamber 323 at a predetermined pitch in the transporting direction of the recording medium. More specifically, the sucking hole 324 is formed in a line for each sucking chamber 323.

A sucking force generating portion 330 communicates with a pressure reducing chamber 321 of a sucking portion 320 through a communicating hole 331 and includes a pump 332 having a centrifugal fan in an inner part. The pump 332 is attached into a predetermined position under the pressure reducing chamber 321 in a communication state with the pressure reducing chamber 321 through the communicating hole 331 and the centrifugal fan is rotated during recording. By the operation of the pump 332, a dynamic pressure loss is generated in each sucking hole 324 so that a negative pressure is applied to the pressure reducing chamber 321.

Recording medium transporting mechanism 350 includes a feeding roller 351 for feeding a recording medium to a portion between a recording head 431 and a sucking unit 310, a driven roller 352 which is caused to come in pressure contact with the feeding roller 351 from above, a discharging roller 353 for discharging the recording medium to an outside, and a spur roller 354 which is caused to come in contact with the discharging roller 353 from above. If the sucking unit 310 can be moved in a discharging direction, the discharging roller 353 and the spur roller 354 do not need to be provided.

As described above, a sucking opening is constituted by the sucking hole 324 and the sucking chamber 323, and furthermore, the sucking hole 324 is formed by a through hole having a small diameter. Consequently, the utilization rate of a negative pressure which can be utilized for the characteristic of the pump 332 is increased and the sucking chamber 323 is formed to be an almost rectangular concave portion having a larger area than the area of the sucking hole 324. Consequently, it is possible to generate a great sucking force (namely negative pressure by area) for the recording medium.

Figure 21:
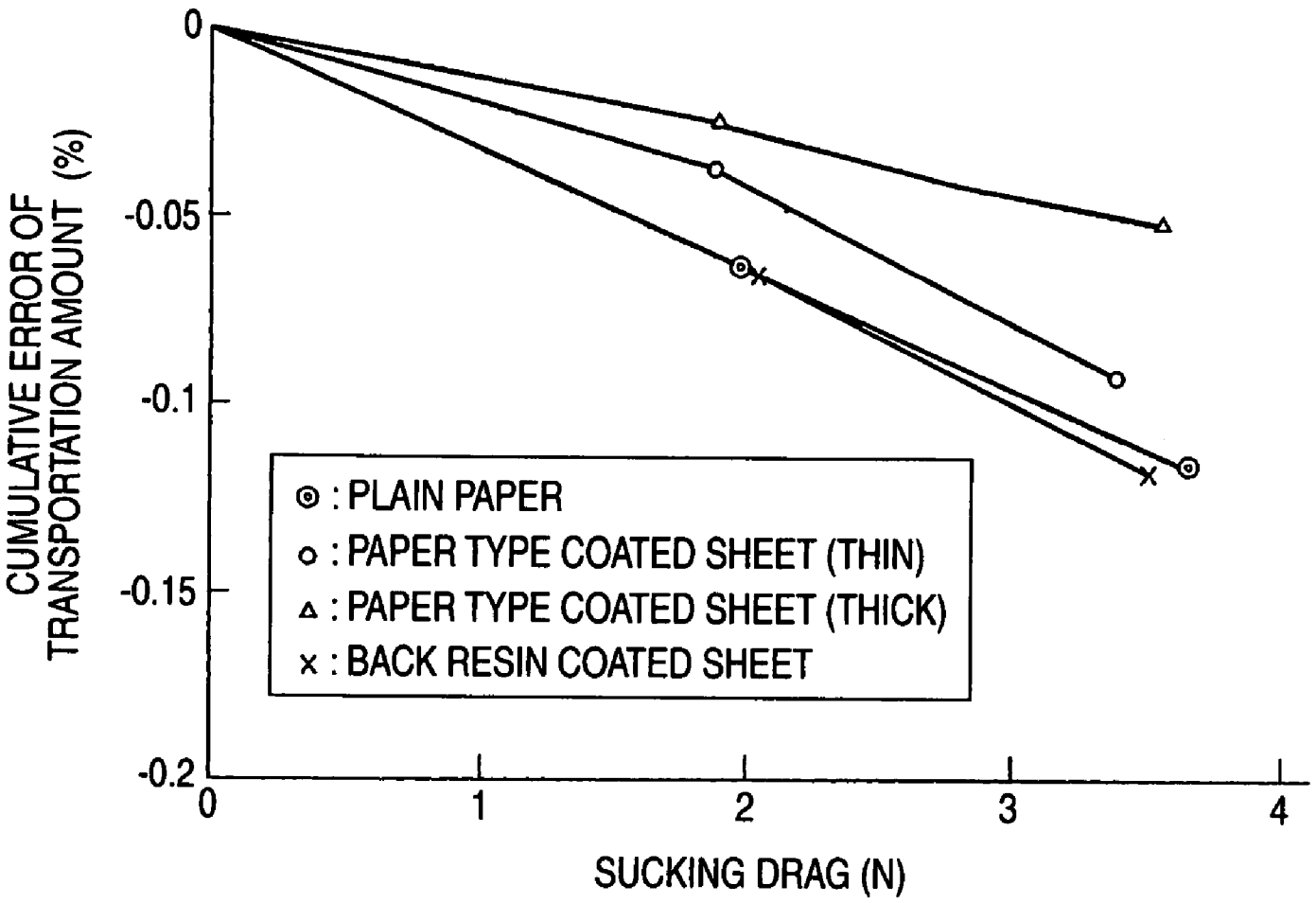
FIG. 21 is a chart showing the relationship between a sucking drag and a cumulative error of a transportation amount which is obtained when different types of recording media are transported.

FIG. 21 is a chart showing the relationship between a sucking drag and a cumulative error of a transportation amount which is obtained when different types of recording media are transported. The sucking drag implies a sucking force multiplied by a coefficient of friction of a recording medium and a recording medium transporting surface. There is shown the relationship between a sucking drag (N) and a cumulative error (%) of the transportation amount which is obtained when a so-called plain paper, a thin paper type coated sheet, a thick paper type coated sheet and a back resin coated sheet are transported as the recording media, respectively. As is apparent from FIG. 21, the transportation amount of the recording medium is slightly decreased by the sucking drag applied to the recording medium. It has been found that a decrease rate is constant in proportion to the sucking drag.

For example, the sucking drag is changed in the following case. In the case in which the recording medium is to be transported from a tip thereof, an area covering the sucking hole 324 with the recording medium is increased so that the sucking drag is increased when the tip portion of the recording medium advances. When the tip portion of the recording medium advances, a rate at which the recording medium covers the sucking hole 324 is increased (a numerical aperture is reduced) and the negative pressure in the pressure reducing chamber 321 is increased so that the increase in the sucking drag is further accelerated.

When a recording medium having a different size, particularly, a different width is to be transported, moreover, a wide recording medium has a large area covering the sucking hole 324 so that the sucking drag is increased. The rate for covering the sucking hole 324 is increased (the numerical aperture is reduced) in the wide recording medium and the negative pressure in the pressure reducing chamber 321 is increased so that the increase in the sucking drag is further accelerated. In the case in which the sucking force is separately set for each type of the recording medium (the driving condition of the pump 332 is changed), the sucking drag is changed. In each of the cases described above, it is possible to obtain high precision in transportation of the recording medium by previously setting the transportation amount of the recording medium in consideration of the decrease rate of the transportation amount of the recording medium.

A recording medium transportation device 300 having such a structure is operated in the following manner. The feeding roller 351 is rotated to feed a recording medium into a portion between the recording head 431 and the sucking unit 310. On the other hand, the pump 332 is driven to cause a sucking force to act on the sucking hole 324 and the sucking chamber 323 through the communicating hole 331 and the pressure reducing chamber 321. Consequently, the recording medium is transported in a state as to be sucked into the recording medium transporting surface 322.

At this time, the transportation amount of the recording medium is corrected in accordance with the sucking drag. More specifically, first of all, the sucking drag is calculated based on the size of the recording medium and the type of the recording medium, and the transportation amount of the recording medium is corrected by the sucking drag thus calculated. Next, the sucking drag is calculated based on the transportation position of the recording medium and the transportation amount of the recording medium is corrected by the sucking drag thus calculated. Consequently, the transportation amount of the recording medium can be always maintained to be constant. Therefore, it is possible to carry out recording with high precision. The recording head 431 discharges ink particles to the recording medium while moving above the recording medium in a main scanning direction, thereby carrying out recording. Then, a discharging roller 353 is rotated to discharge, to an outside, the recording medium over which the recording is completely performed.

Figure 22:
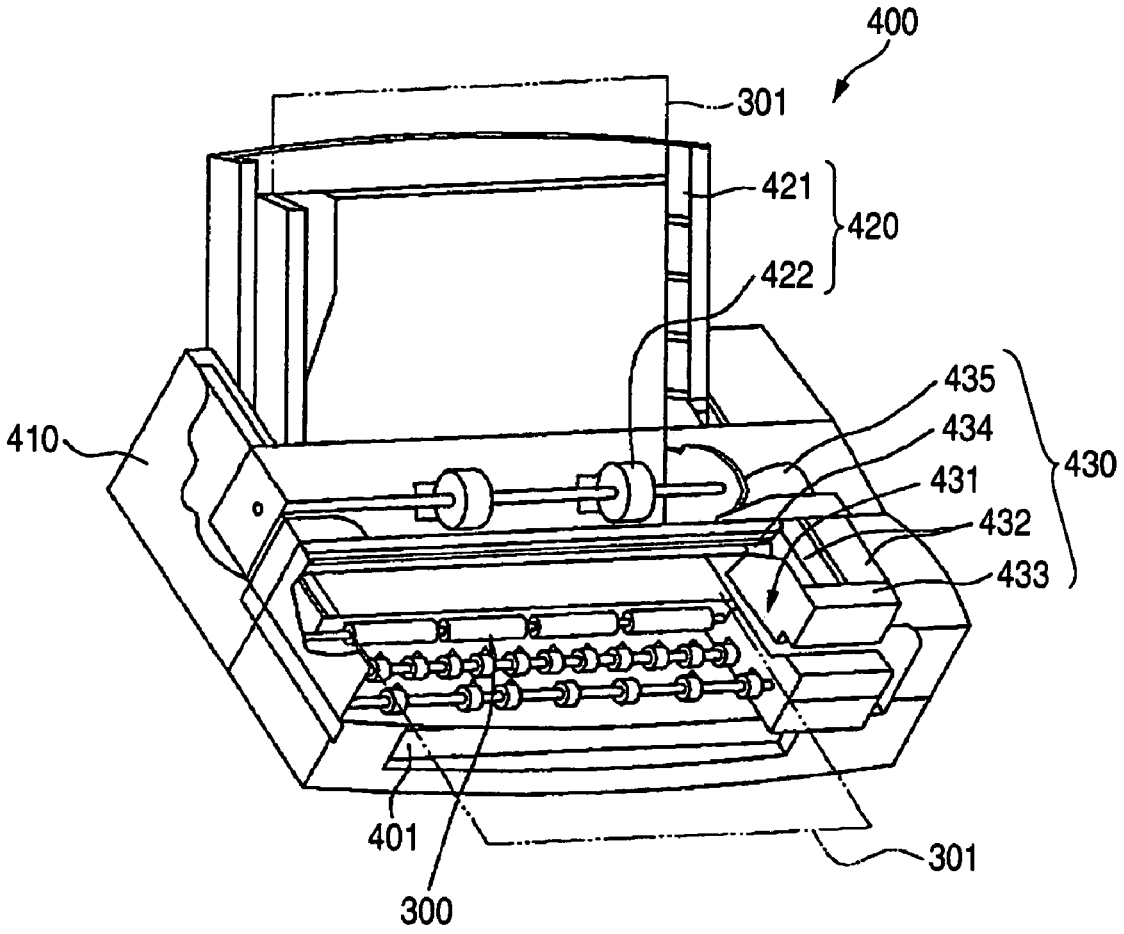
FIG. 22 is a perspective view showing an ink jet printer to be a recording apparatus comprising the recording medium transportation device according to the invention.
Figure 23:
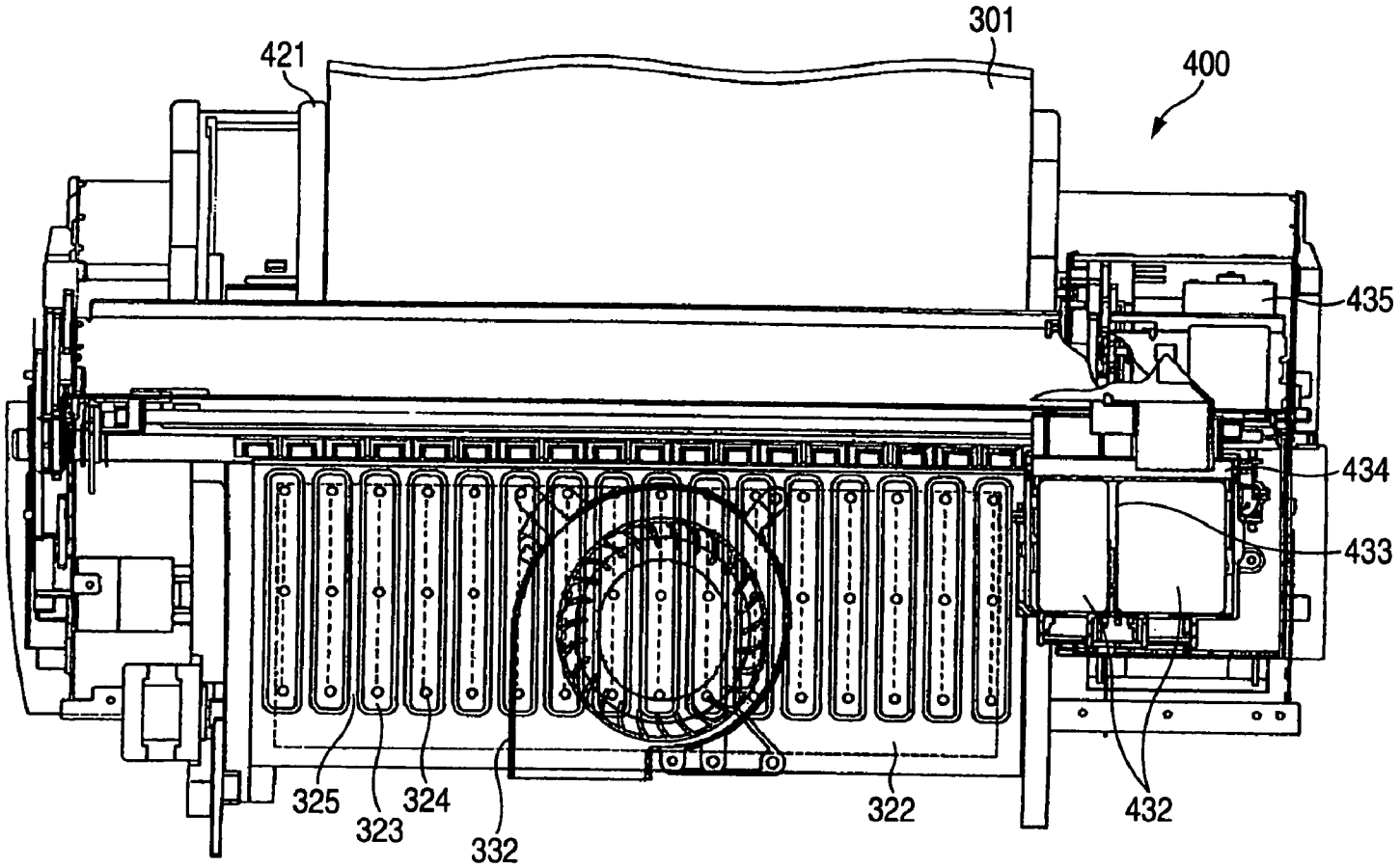
FIG. 23 is a plan view showing the main part of the ink jet printer in FIG. 22.
Figure 24:
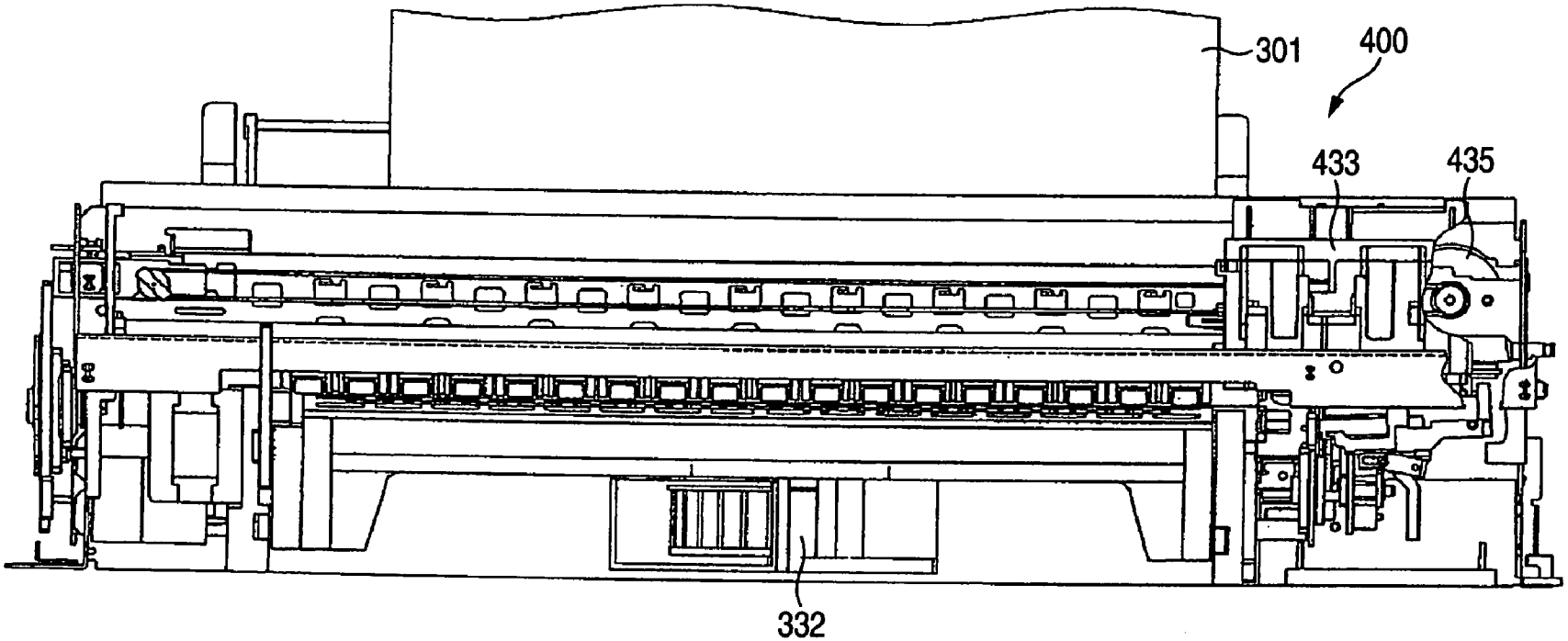
FIG. 24 is a front view showing the main part of the ink jet printer in FIG. 22.
Figure 25:
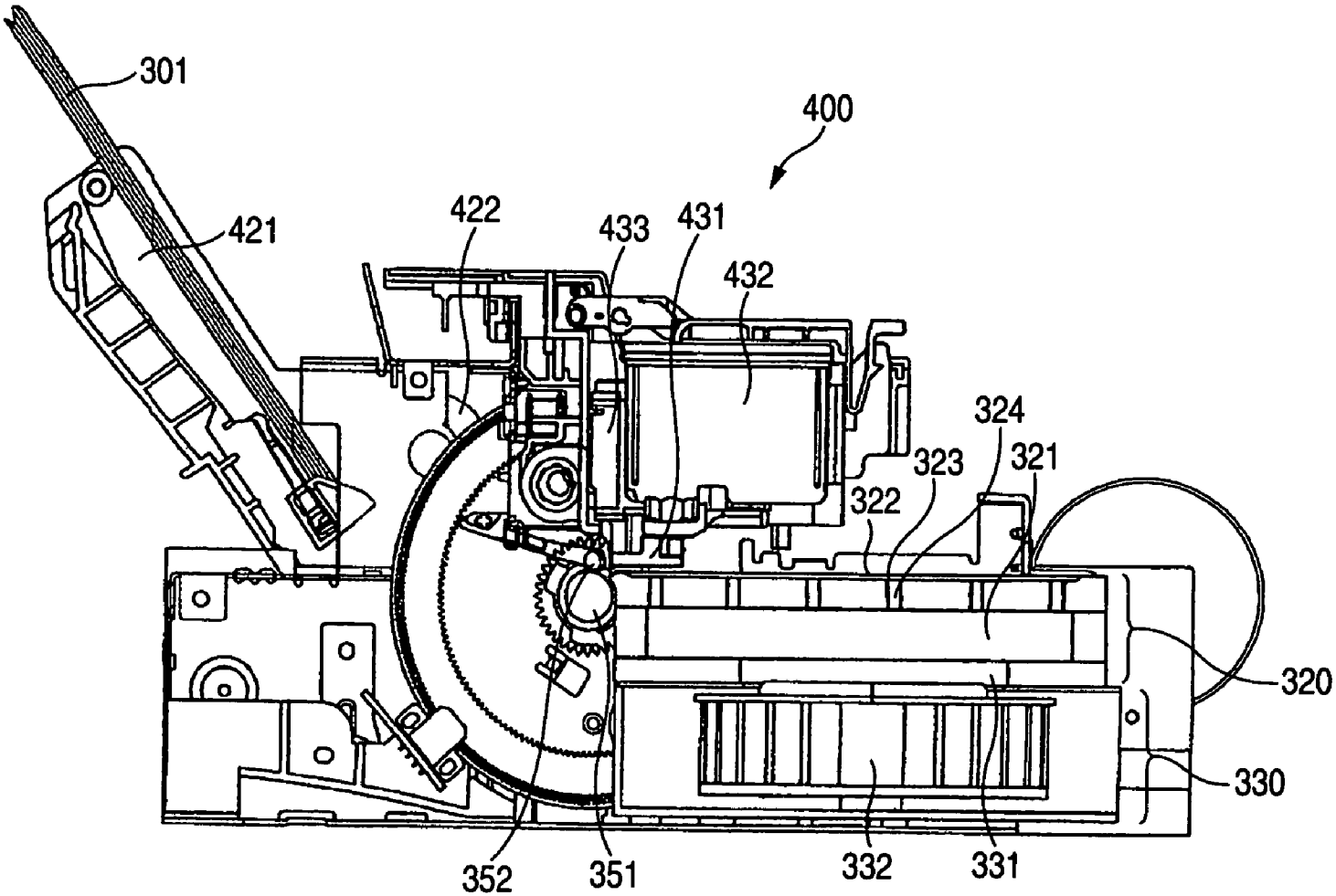
FIG. 25 is a side view showing the main part of the ink jet printer in FIG. 22.

FIG. 22 is a perspective view showing an inkjet printer as a recording apparatus providing the recording medium transportation device 300 of the invention, and FIG. 23 to FIG. 25 are a plane view, a front view, and a side view showing the main portions thereof. The inkjet printer 400 provides an automatic sheet feed (ASF) unit 420 attached obliquely at the rear side upper portion of a printer main body 410, a recording portion 430 built in the printer main body 410, and a recording medium transportation device 300. For the recording medium, various kinds such as exclusive sheet of the inkjet printer 400, normal sheet, OHP film, tracing paper, post card, and so on can be used.

The ASF unit provides a tray 421 storing the sheets 301, a sheet feed roller 422 drawing out the sheet 301 from the tray 321 and feeding. A recording portion 430 provides a carriage installing a recording head 431 and an ink cartridge, a DC motor 435 moving the carriage 433 along a guide axis 434 arranged to main scanning direction, and the like. The recording head 431 has a nozzle line consisting of plural nozzles, for example 96 pieces at each color of cyan, magenta, yellow, light cyan, light magenta, light yellow, and black for example.

The recording medium transportation device 300 comprises the sucking unit 310 constituted by the sucking portion 320 in an upper stage and the sucking force generating portion 330 in a lower stage which suck and hold a recording medium during recording, and the recording medium transporting mechanism 350 for transporting the recording medium from the upstream side to the downstream side in the sucking unit 310. The sucking portion 320 has the pressure reducing chamber 321 formed in the inner part, the sucking chambers 323 formed, on the recording medium transporting surface 322, to be the concave portions which take a long rectangular shape in the transporting direction of the recording medium, and the sucking holes 324 for causing the sucking chambers 323 to communicate with the pressure reducing chamber 121 respectively.

The sucking force generating portion 330 is connected to the pressure reduction chamber 321 of the sucking portion 320 through a connecting aperture 331, and has a pump 332 providing a centrifugal fan at inside thereof. The pump 332 is attached at the lower predetermined position of the pressure reduction chamber 321 through the connecting aperture 331 at the state connecting to the pressure reduction chamber 321, and the centrifugal fan rotates at recording.

Recording medium transporting mechanism 350 has a feeding roller 351 for feeding a recording medium into a portion between the recording head 431 and the sucking unit 310, and a driven roller 352 which is caused to come in pressure contact with the feeding roller 351 from above. A transportation control portion which is not shown serves to correct the transportation amount of the recording medium in accordance with a sucking force and to control the transportation of the recording medium in consideration of the transportation amount which is corrected. Preferably, the corrected transportation amount of the recording medium is calculated based on the sucking drag obtained in accordance with the sucking force, or the transportation amount may be determined by the obtained sucking force using a table defining the relationship among the transportation amount, the kinds of the transported sheets and the corresponding sucking force data. While an ink jet printer 400 having the movable sucking unit 310 in a discharging direction which does not require the discharging roller 353 for discharging the recording medium to an outside and a spur roller 354 to come in contact with the discharging roller 353 from above is used in the embodiment, it is also possible to employ an ink jet printer having the discharging roller 353 and the spur roller 354.

The ink jet printer 400 having such a structure is operated in the following manner. When a recording instruction for a sheet 301 accommodated in a tray 421 is input by a host computer which is not shown, a sheet feed roller 322 is rotated to pick up and feed the sheets 301 accommodated in the tray 421 one by one. Furthermore, the feeding roller 352 is rotated to feed the paper 301 into the portion between the recording head 431 and the sucking unit 310.

On the other hand, the pump 332 is driven to cause the sucking force to act on the sucking hole 324 and the sucking chamber 323 through the communicating hole 331 and the pressure reducing chamber 321. Then, the sheet 301 is transported in such a state as to be sucked into the recording medium transporting surface 325. First of all, the transportation is controlled by calculating a sucking drag based on the size of the recording medium and the property of the recording medium and correcting the transportation amount of the recording medium with the calculated sucking drag. Further, the transportation is controlled by calculating the sucking drag based on the transportation position of the recording medium and correcting the transportation amount of the recording medium with the sucking drag thus calculated. Consequently, the transportation amount of the recording medium can be always maintained to be constant. Thus, it is possible to carry out recording with high precision.

Then, a DC motor 435 is driven to move a carriage 433 along a guide shaft 434 through a timing belt. At this time, the recording head 431 ejects, onto the sheet 301, an ink supplied for each color from an ink cartridge 432 as a very small ink droplet from all or a part of nozzles according to recording data, thereby carrying out the recording. Thereafter, the discharging roller 353 is rotated to discharge the sheet 301 over which the recording is completely carried out from a sheet discharging port 401 to an outside. As described above, it is possible to obtain high precision in recording by high precision in transportation without depending on the size of the recording medium, the property of the recording medium and the transportation position of the recording medium, and furthermore, without requiring a special additional device.

What is claimed is:

1. A recording apparatus comprising:

a suction unit for sucking a medium which has passed in a recording unit, said suction unit having a plurality of suction ports in a transporting direction of the medium; and an opening and closing mechanism provided on a side of the suction unit for opening and closing the sucking ports;

wherein when the medium is not transported on the suction unit, the suction ports are closed, and when the medium is transported on the suction unit, the suction ports are sequentially opened in accordance with transportation of a leading end of the medium, and a sucking force provided by the suction ports to the medium is controllable in accordance with a property of the medium.

2. The recording apparatus according to claim 1, wherein the opening and closing mechanism includes a shutter made of a sheet material on provided on the sucking unit.

3. The recording apparatus according to claim 2, wherein the opening and closing mechanism includes a cam mechanism for driving the shutter.

4. The recording apparatus according to claim 2, wherein holes corresponding to the suction ports are formed on the shutter.

5. The recording apparatus according to claim 4, wherein the holes formed on the shutter are provided so as to be longer on an upstream side of the transportation of the medium than on a downstream side of the transportation of the medium.

6. The recording apparatus according to claim 1, wherein the sucking force is changed so as to become larger as the medium becomes thicker.

7. The recording apparatus according to claim 1, further comprising an operation unit to change the suction force that is operable for a user.

8. The recording apparatus according to claim 1, wherein the suction ports are constituted by at least two rows of the suction ports, the suction ports in each row are arranged substantially perpendicular to a transportation direction of the medium, the holes formed on the shutter are constituted by at least two rows of the holes corresponding to the suction ports, and the holes in a row provided on an upstream side of the transportation of the medium are formed longer than the holes in a row provided on a downstream side of the transportation of the medium.

* * * * *